US010638849B2

(12) United States Patent
Remelts et al.

(10) Patent No.: US 10,638,849 B2
(45) Date of Patent: May 5, 2020

(54) CONVERTIBLE BODY SUPPORT STRUCTURE

(71) Applicant: STEELCASE INC., Grand Rapids, MI (US)

(72) Inventors: Matthew David Remelts, Grand Rapids, MI (US); Devon Robert Robinson, Ann Arbor, MI (US); Steven James Beukema, Grand Rapids, MI (US); Vernie F. Holford, Fremont, MI (US); Adam C. Bedford, Gowen, MI (US); Michael Scott Garner, North Barrington, IL (US); Marc Eberlein, Hudsonville, MI (US)

(73) Assignee: STEELCASE INC., Grand Rapids, MI (US)

( * ) Notice: Subject to any disclaimer, the term of this patent is extended or adjusted under 35 U.S.C. 154(b) by 307 days.

(21) Appl. No.: 15/794,645

(22) Filed: Oct. 26, 2017

(65) Prior Publication Data

US 2018/0116409 A1 May 3, 2018

Related U.S. Application Data

(60) Provisional application No. 62/414,282, filed on Oct. 28, 2016.

(51) Int. Cl.
*A47C 17/165* (2006.01)
*A47C 17/86* (2006.01)
(Continued)

(52) U.S. Cl.
CPC ..... *A47C 17/165* (2013.01); *A47C 17/14* (2013.01); *A47C 17/86* (2013.01); *A47C 20/027* (2013.01); *A47C 21/003* (2013.01); *A47C 29/003* (2013.01)

(58) Field of Classification Search
CPC ..... A47C 17/165; A47C 17/14; A47C 20/027; A47C 21/003; A47C 17/86; A47C 29/003; A47C 17/16; A47C 17/161; A47C 17/162
See application file for complete search history.

(56) References Cited

U.S. PATENT DOCUMENTS 250,810 A 12/1881 Hentshel
302,904 A 8/1884 Garland
(Continued)

FOREIGN PATENT DOCUMENTS

CN 201854890 U 6/2011
CN 102178403 A 9/2011
(Continued)

OTHER PUBLICATIONS

Pinterest—The world's catalog of ideas: Explore Hockey Room, Hockey Stick Coat Rack, and more!, obtained from the internet on Jun. 15, 2016 from: https://www.pinterest.com/pin/227009637438826549/, 4 pgs.

*Primary Examiner* — Eric J Kurilla
*Assistant Examiner* — James T Coble
(74) *Attorney, Agent, or Firm* — Brinks Gilson & Lione

(57) ABSTRACT

A body support structure includes a base and a cushion moveable between a seating configuration and a sleeping configuration. The cushion may include foldable first and second sections. In one embodiment, a spacer includes first and second support surfaces, and is pivotal between an upright position, wherein the first support surface engages and supports the cushion in the seating configuration, and a down position, wherein the second support surface engages and supports the cushion in the sleeping configuration. Methods of reconfiguring a body support structure are also provided.

23 Claims, 15 Drawing Sheets

(51) Int. Cl.

| | |
|---|---|
| ***A47C 21/00*** | (2006.01) |
| ***A47C 20/02*** | (2006.01) |
| ***A47C 17/14*** | (2006.01) |
| ***A47C 29/00*** | (2006.01) |

(56) References Cited

U.S. PATENT DOCUMENTS 532,109 A 1/1895 Stinchcomb
739,352 A * 9/1903 Schuette ..... A47C 29/003 5/414
905,660 A 12/1908 Cowdrey
990,055 A 4/1911 Lightner
1,208,979 A 12/1916 Kahre
1,333,600 A 3/1920 Bell
1,682,855 A 9/1928 Rose
1,714,422 A 5/1929 Hanson
1,719,966 A 7/1929 Burns
1,832,002 A 11/1931 Clarke
RE18,560 E 8/1932 Thomas
1,885,160 A 11/1932 Weinman
1,926,201 A 9/1933 Kahns
2,098,655 A 11/1937 de Lisle
2,337,675 A 12/1943 McNeil
2,352,989 A 7/1944 Woller
2,483,920 A * 10/1949 McLean ..... A47B 23/02 108/49
2,621,339 A 12/1952 Little
2,635,680 A 4/1953 Zentmire
2,703,265 A 3/1955 Wolfe
2,709,818 A 6/1955 Freese
2,749,196 A 6/1956 Wolfe
2,904,798 A 9/1959 Heflin
2,981,311 A 4/1961 Hacker
3,054,122 A 9/1962 Sarkus
3,062,602 A 11/1962 O'Brien et al.
3,088,129 A 5/1963 Foseid
3,095,835 A 7/1963 Smith
3,151,342 A 10/1964 McLean
3,276,045 A 10/1966 Bement
2,808,595 A 10/1967 McLean
3,517,625 A 6/1970 Swett
3,572,831 A 3/1971 Barecki et al.
D221,583 S 8/1971 Donato
3,601,443 A 8/1971 Jones
3,813,711 A 6/1974 Fiaschi
3,854,155 A 12/1974 Picard
3,893,729 A 7/1975 Sherman et al.
3,957,302 A 5/1976 Jones
4,158,315 A 6/1979 Kensrue et al.
4,170,800 A 10/1979 Wiberg
4,292,698 A 10/1981 Acker
D267,046 S 11/1982 Bessone
4,378,709 A 4/1983 Chitayat
D270,481 S 9/1983 Whitright
4,404,698 A 9/1983 Koncelik et al.
4,455,008 A 6/1984 MacKew
4,475,776 A 10/1984 Teramachi
4,494,258 A 1/1985 Blevins et al.
4,637,666 A 1/1987 Worrell et al.
4,639,953 A 2/1987 McElmurry et al.
4,645,167 A 2/1987 Hardwick
4,686,727 A 8/1987 Wilkinson
4,709,961 A 12/1987 Hill
4,779,537 A 10/1988 Hafner et al.
4,780,919 A * 11/1988 Harrison ..... A61G 7/02 5/308
4,793,479 A 12/1988 Otsuka et al.
4,798,479 A 1/1989 Morita
4,815,862 A 3/1989 Mugglestone et al.
4,815,863 A 3/1989 Forster
4,834,449 A 5/1989 Engelman
4,848,833 A 7/1989 Grail
4,852,500 A 8/1989 Ryburg et al.
4,932,067 A 6/1990 Peter et al.
4,977,848 A 12/1990 Currey
5,035,464 A 7/1991 Spallholtz
5,070,969 A 12/1991 Neumuller
5,088,135 A 2/1992 Violette
5,129,702 A 7/1992 Ervin
5,169,210 A 12/1992 Fricano
5,195,194 A * 3/1993 Bradley ..... A47C 17/161 5/37.1
D339,246 S 9/1993 Hutton
5,281,001 A 1/1994 Bergsten et al.
5,294,201 A 3/1994 Agari
5,352,017 A 10/1994 Berning
5,380,099 A 1/1995 Teramacji
5,395,045 A 3/1995 Gaupp et al.
5,423,596 A 6/1995 Laughlin et al.
5,509,151 A 4/1996 Fireman et al.
5,544,938 A 8/1996 Saul et al.
5,547,247 A 8/1996 Dixon
5,632,521 A 5/1997 Archhambault et al.
D382,129 S 8/1997 Lewis
D390,029 S 2/1998 Hutton
5,754,995 A 5/1998 Behrendt
5,775,778 A 7/1998 Riley et al.
5,787,522 A 8/1998 Swihart
5,871,255 A 2/1999 Harland et al.
5,884,974 A 3/1999 Bergsten et al.
D411,634 S 6/1999 Connelly
D414,713 S 10/1999 Renk
D431,381 S 10/2000 Roset
D435,912 S 1/2001 Muller
6,170,410 B1 1/2001 Gioacchini et al.
6,174,086 B1 1/2001 Ng et al.
D439,071 S 3/2001 D'Urso et al.
6,196,610 B1 3/2001 Pesta et al.
D441,978 S 5/2001 Hutton
D444,305 S 7/2001 Mourgue
D446,961 S 8/2001 Natuzzi et al.
6,347,418 B1 2/2002 Leib
6,352,302 B1 3/2002 Piretti, Jr.
6,364,215 B1 4/2002 Andre et al.
6,412,862 B1 7/2002 Dickerson et al.
6,422,646 B1 7/2002 McNally
D465,874 S 11/2002 Garvin et al.
6,493,890 B2 12/2002 Smeed
6,523,899 B1 2/2003 Tame
6,622,321 B1 9/2003 Leib
6,636,865 B2 10/2003 Ahmadi
D485,003 S 1/2004 Olson
6,702,389 B2 3/2004 Hall, Jr. et al.
6,742,204 B1 6/2004 Barker
6,742,755 B2 6/2004 Pryor
6,751,878 B2 6/2004 Hamann
6,843,531 B2 1/2005 Williams
6,904,628 B2 6/2005 Murphy et al.
6,918,143 B2 7/2005 Wiberg
D508,042 S 8/2005 Oikawa
D519,743 S 5/2006 Suzuki et al.
7,082,882 B2 8/2006 Heimbrock
D530,040 S 10/2006 Smith et al.
7,198,316 B2 4/2007 Lutzka et al.
7,252,273 B2 8/2007 Lewellen et al.
7,292,696 B2 11/2007 Brennan et al.
D557,450 S 12/2007 Barbeau et al.
D557,532 S 12/2007 True et al.
D559,594 S 1/2008 Loudon
7,380,886 B1 6/2008 Copello
D579,136 S 10/2008 Massucci
7,438,362 B2 10/2008 Dotta et al.
7,452,032 B1 11/2008 Roleder et al.
7,509,696 B2 3/2009 Soto et al.
D606,235 S 12/2009 Mama et al.
7,624,463 B2 12/2009 Graham et al.
7,673,942 B2 3/2010 Tuckey et al.
D613,899 S 4/2010 Whittier et al.
7,708,345 B2 5/2010 Grabowski et al.
7,748,061 B2 7/2010 Pine
D629,221 S 12/2010 Starck
7,942,579 B2 5/2011 Shirai
D640,481 S 6/2011 Bush
D643,964 S 8/2011 Heyrman

(56) References Cited

U.S. PATENT DOCUMENTS

| | | | |
|---|---|---|---|
| D643,965 | S | 8/2011 | Sprengers |
| 7,992,913 | B2 | 8/2011 | Zelmanov et al. |
| D648,565 | S | 11/2011 | Frinier |
| 8,054,388 | B2 | 11/2011 | Hurd |
| 8,065,768 | B2 | 11/2011 | Graham et al. |
| D660,043 | S | 5/2012 | Nguyen |
| 8,336,142 | B1 | 12/2012 | See et al. |
| D676,996 | S | 2/2013 | Gismondi |
| 8,499,378 | B2 | 8/2013 | Kelly et al. |
| D701,981 | S | 4/2014 | Gates |
| 8,696,056 | B2 | 4/2014 | Corcorran et al. |
| 8,783,951 | B2 | 7/2014 | Kondo |
| 8,858,083 | B2 | 10/2014 | Takahashi |
| 8,887,644 | B2 | 11/2014 | Edinger et al. |
| 8,950,817 | B2 | 2/2015 | Iacovoni et al. |
| 8,985,684 | B2 | 3/2015 | Zheng et al. |
| D727,648 | S | 4/2015 | De'Silva |
| 9,044,099 | B2 | 6/2015 | Bouche |
| D734,531 | S | 7/2015 | Tragatschnig |
| 9,102,410 | B2 | 8/2015 | Frost et al. |
| 9,108,280 | B2 | 8/2015 | Wang et al. |
| D743,726 | S | 11/2015 | Yeh |
| 9,198,517 | B2 | 12/2015 | Qiao |
| 9,380,866 | B1 | 7/2016 | Davis |
| 2002/0080974 | A1 | 6/2002 | Grawrock |
| 2003/0167566 | A1 | 9/2003 | Inagaki |
| 2006/0049682 | A1 | 3/2006 | Yamanaka |
| 2006/0119233 | A1 | 6/2006 | Thomas |
| 2007/0143919 | A1 | 6/2007 | Erdman |
| 2007/0284920 | A1 | 12/2007 | Mahaffey et al. |
| 2008/0066227 | A1 | 3/2008 | James et al. |
| 2008/0111041 | A1 | 5/2008 | Drew et al. |
| 2008/0277977 | A1 | 11/2008 | Kagan et al. |
| 2010/0264791 | A1 | 10/2010 | Rajeswaran |
| 2011/0101763 | A1 | 5/2011 | Chen |
| 2012/0212021 | A1 | 8/2012 | Hunter et al. |
| 2013/0129265 | A1 | 5/2013 | Jahrling |
| 2014/0252812 | A1 | 9/2014 | Ton |
| 2015/0067963 | A1 | 3/2015 | Grimoldi |
| 2015/0257958 | A1 | 9/2015 | Allen et al. |

FOREIGN PATENT DOCUMENTS

| | | | | |
|---|---|---|---|---|
| CN | 202051263 | U | 11/2011 | |
| CN | 205125660 | U | 4/2016 | |
| CN | 105686418 | A | 6/2016 | |
| CN | 105686469 | A | 6/2016 | |
| DE | 153893 | | 12/1903 | |
| DE | 462913 | | 11/1927 | |
| DE | 1529474 | A1 * | 12/1969 | ..... A47C 17/161 |
| DE | 2817792 | A1 | 10/1979 | |
| DE | 8032062 | U1 | 5/1982 | |
| DE | 3519112 | A1 | 1/1986 | |
| DE | 3531934 | C1 | 10/1986 | |
| DE | 3742813 | A1 | 7/1989 | |
| DE | 19750571 | A1 | 4/1999 | |
| EP | 0172320 | A1 | 2/1986 | |
| EP | 0692646 | A1 | 1/1996 | |
| EP | 1254617 | A2 | 11/2002 | |
| EP | 1407689 | A1 | 4/2004 | |
| EP | 1516558 | A1 | 3/2005 | |
| EP | 2166170 | A1 | 3/2010 | |
| ES | 1000347 | U | 3/1988 | |
| ES | 2262389 | A | 11/2006 | |
| FR | 812671 | | 5/1937 | |
| FR | 1007580 | | 5/1952 | |
| FR | 1176307 | | 4/1959 | |
| FR | 1309205 | A | 11/1962 | |
| FR | 1330771 | | 6/1963 | |
| FR | 2743273 | A1 | 7/1997 | |
| GB | 3640 1908 | | 2/1909 | |
| GB | 426465 | | 4/1935 | |
| GB | 712223 | | 7/1954 | |
| GB | 728690 | | 4/1955 | |
| GB | 789138 | | 1/1958 | |
| GB | 794527 | | 5/1958 | |
| GB | 812472 | | 4/1959 | |
| GB | 863058 | | 3/1961 | |
| GB | 2124897 | A | 2/1984 | |
| JP | 2006-326040 | A | 12/2006 | |
| KR | 20130038430 | A | 4/2013 | |
| WO | WO 87/01019 | A1 | 2/1987 | |
| WO | WO 98/09552 | A1 | 3/1998 | |
| WO | WO 2014/027774 | A1 | 2/2014 | |

* cited by examiner

CONVERTIBLE BODY SUPPORT STRUCTURE

This application claims the benefit of U.S. Provisional Patent Application Ser. No. 62/414,282, filed Oct. 28, 2016, the entire disclosure of which is hereby incorporated herein by reference.

FIELD OF THE INVENTION

The present application relates generally to a body support structure, such as a sofa, which may be converted from a seating configuration to sleeping configuration, and which includes various accessories for the user.

BACKGROUND

Body support structures, including for example, chairs and sofas, may be configured to be convertible from a seating configuration to a sleeping configuration. Often, such body support structures require complicated linkage mechanisms to effect the conversion, and may occupy relatively large footprints when positioned in the sleeping configuration. As such, the structures may not be well suited for relatively confined spaces, such as hospital or hotel rooms. In addition, such body support structures are typically not configured with various accessories, such as a worksurface, storage, and/or lighting, which may enhance the utility of such body support structures in a confined space.

SUMMARY

The present invention is defined by the following claims, and nothing in this section should be considered to be a limitation on those claims.

In one aspect, one embodiment of a body support structure includes a base defining an upwardly facing first body support surface and a cushion moveable between a seating configuration and a sleeping configuration. At least a portion of the cushion is spaced above the first body support surface when in the seating configuration. The cushion is supported by and overlies at least a portion of the first body support surface when in the sleeping configuration. The cushion defines a forwardly facing second body support surface when in the seating configuration and an upwardly facing third body support surface when in the sleeping configuration. The first body support surface supports the second body support surface when the cushion is in the sleeping configuration. A spacer includes first and second support surfaces. The spacer is pivotally coupled to the base and is pivotal between an upright position, wherein the first support surface engages and supports the cushion in the seating configuration, and a down position, wherein the second support surface engages and supports the cushion in the sleeping configuration.

In another aspect, one embodiment of a body support structure includes a base defining an upwardly facing first body support surface and a foldable cushion having first and second sections. Each of the first and second sections is tapered from a first end to a second end and includes first and second sides. The second end of the first section is hingedly connected to the first end of the second section. The first and second sections are moveable between a seating configuration, wherein the second sides are facing each other and the first sides are facing away from each other, and a sleeping configuration wherein the second sides are facing upwardly and define a second body support surface and the first sides are facing downwardly and are supported on the first body support surface. The second body support surface is substantially horizontal when the first and second sections are in the sleeping configuration.

In another aspect, a carriage assembly includes a rail having a pair of outwardly facing grooves disposed on opposite sides of the rail. A carriage includes a body and at least a pair of spaced apart wheels rotatably mounted to the body. The wheels are disposed in and engage the grooves. The body includes at least a pair of guards covering the wheels at one end of the body. Each guard includes a finger disposed in one of the grooves.

In other aspects, the body support structure may be configured with various lighting and storage solutions, a moveable worksurface and a moveable canopy. The base may also be reconfigurable to accommodate different length cushions and storage solutions.

In another aspect, one embodiment of a method of reconfiguring a body support structure includes providing a base defining an upwardly facing first body support surface, positioning a cushion in a seating configuration wherein at least a portion of the cushion is positioned above the first body supporting surface and defines a forwardly facing second body support surface, and supporting the cushion in the seating configuration with a first support surface of a spacer pivotally coupled to the base in an upright position. The method further includes moving the cushion to a sleeping configuration, wherein the second body support surface of the cushion is supported by and overlies at least a portion of the first body support surface, and wherein the cushion defines an upwardly facing third body support surface, and pivoting the spacer from the upright position to a down position, and supporting the second body support surface of the cushion in the sleeping configuration with a second support surface of the spacer.

In yet another aspect, one embodiment of a method of reconfiguring a body support structure includes providing a base defining an upwardly facing first body support surface and positioning first and second sections of a cushion in a seating configuration, wherein each of the first and second sections is tapered from a first end to a second end and comprises first and second sides, wherein the second sides are facing each other and the first sides are facing away from each other. The method further includes unfolding the first and second sections from the seating configuration to a sleeping configuration, wherein the second sides are facing upwardly and define a substantially horizontal second body support surface and the first sides are facing downwardly, and supporting the first sides on the first body support surface.

In yet another aspect, a circadian rhythm light includes a housing and a light source disposed in the housing. A control system is operable to change the color temperature of the light source between at least first and second color temperatures associated with at least first and second time periods, wherein a first color temperature transition runs for a third time period between the first and second time period, and a fourth color temperature transition runs for a fourth time period between the second and first time period. The control system includes a switch operable to turn the circadian rhythm light on, wherein the circadian rhythm light turns on at a designated color temperature and intensity correlated with a time of day or night the light is turned on.

The various embodiments of body support structures and methods provide significant advantages over other body support structures. For example and without limitation, the cushion may be quickly and easily moved between the seating and sleeping configurations without complicated and expensive linkages. Moreover, the orientation of the base and cushion ensures that the cushion does not shift in the sleeping configuration, while providing a comfortable, reclined support surface in the seating configuration. The various accessories allow the user to maximize the utility of the body support structure, including use of a moveable worksurface for reading, writing or eating, as well as providing storage and privacy.

In addition, the circadian rhythm light may be programmed to correspond with a predetermined circadian rhythm, and may advance or delay the circadian rhythm. In this way, for example in a patient room susceptible to multiple interruptions, the patient, and other room occupants, are exposed to a light source in tune with the circadian rhythms. Moreover, the light, when turned on, will illuminate to a color temperature and intensity associated with the time of day the light is turned on.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
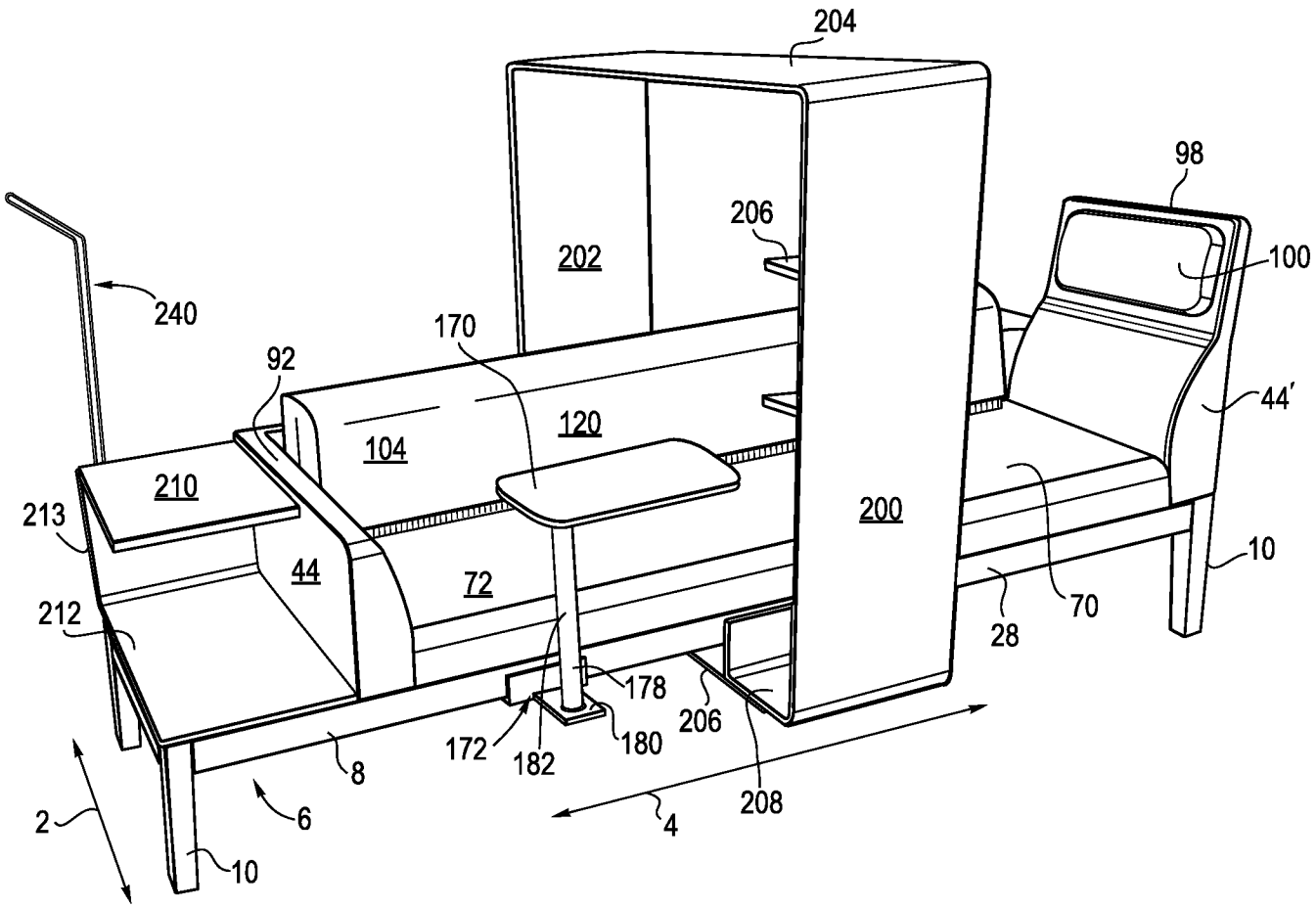
FIG. 1 is a perspective view of one embodiment of convertible body support structure with a backrest cushion in a folded seating configuration.
Figure 2:
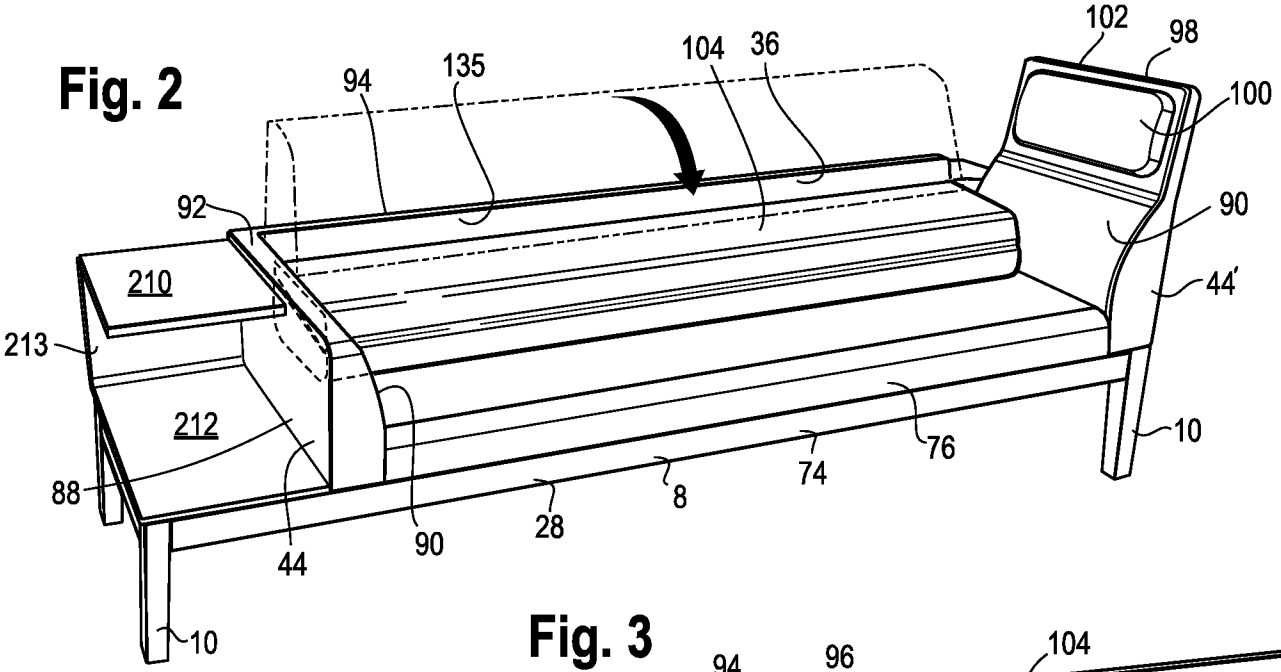
FIG. 2 is a perspective view of the body support structure shown in FIG. 1 with the cushion in a folded intermediate configuration.

It should be understood that the term "plurality," as used herein, means two or more. The term "longitudinal," as used herein means of or relating to a length or lengthwise direction 2, for example a direction running from a top to bottom of a backrest, or a front to back of a seat, and vice versa (bottom to top and back to front). The term "lateral," as used herein, means situated on, directed toward or running in a side-to-side direction 4 of the backrest or seat. The term "coupled" means connected to or engaged with whether directly or indirectly, for example with an intervening member, and does not require the engagement to be fixed or permanent, although it may be fixed or permanent. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first direction may be the same as a second direction, with each simply being applicable to different components. The terms "upper," "lower," "rear," "front," "fore," "aft," "vertical," "horizontal," and variations or derivatives thereof, refer to the orientations of the exemplary seating structure as shown in FIGS. 1 and 2. The phrase body support structure includes without limitation office furniture, home furniture, outdoor furniture and vehicular seating, including automotive, airline, marine and passenger train seating, and may include without limitation chairs, sofas, and other pieces of furniture or types of body supporting structures.

Base

Referring to FIGS. 1-9, a base 6 includes a frame structure 8 and leg assemblies 10 forming a support structure, and a seat cushion 70 supported by the frame structure. Various aspects of the frame structure and leg assemblies are described and disclosed in U.S. Pat. No. 8,950,817, entitled "Article of Furniture With Modular Construction" and assigned to Steelcase Inc., the Assignee of the present application, the entire disclosure of which is hereby incorporated herein by reference.

Figure 6:
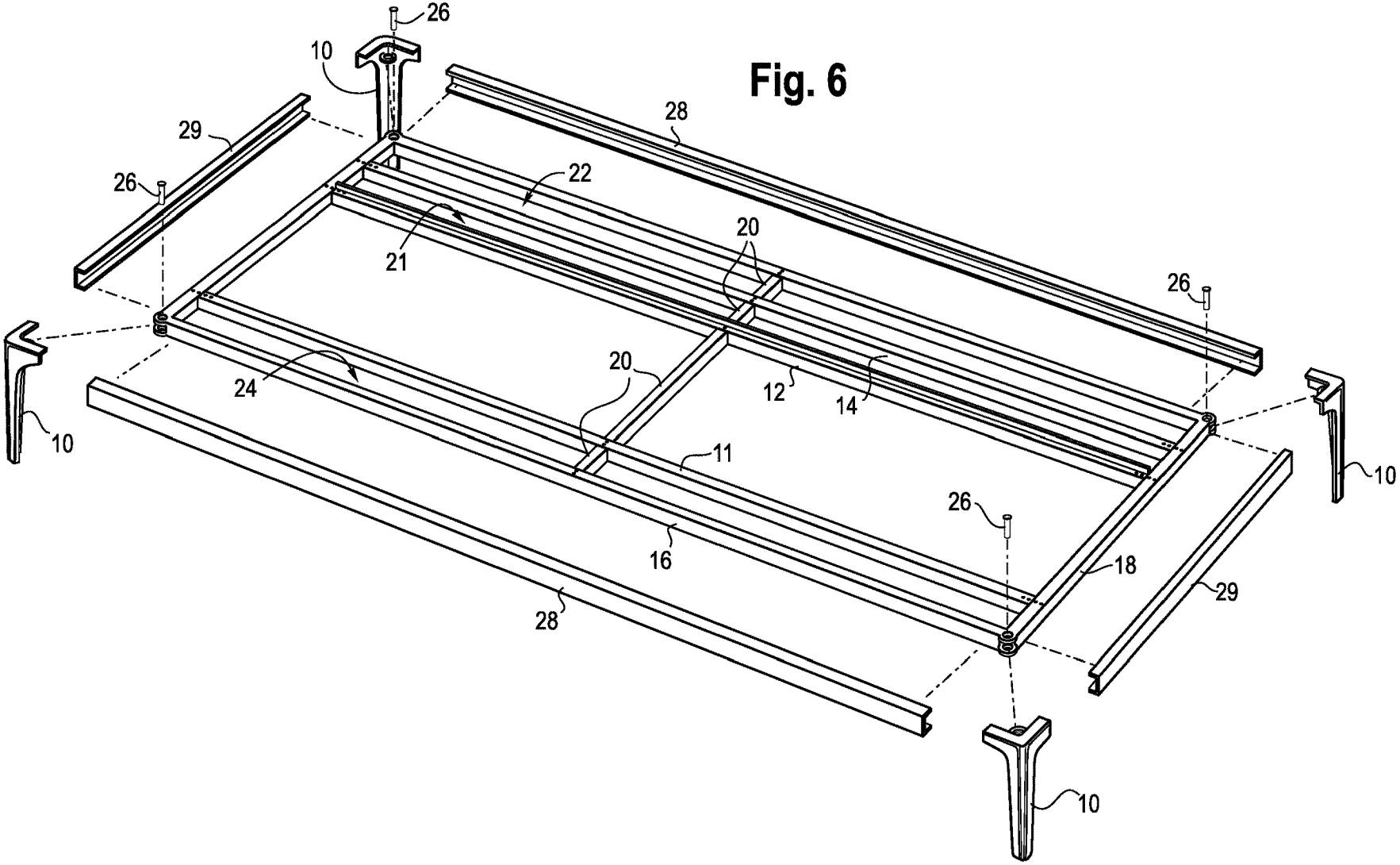
FIG. 6 is an exploded perspective view of one embodiment of a base frame.
Figure 7:
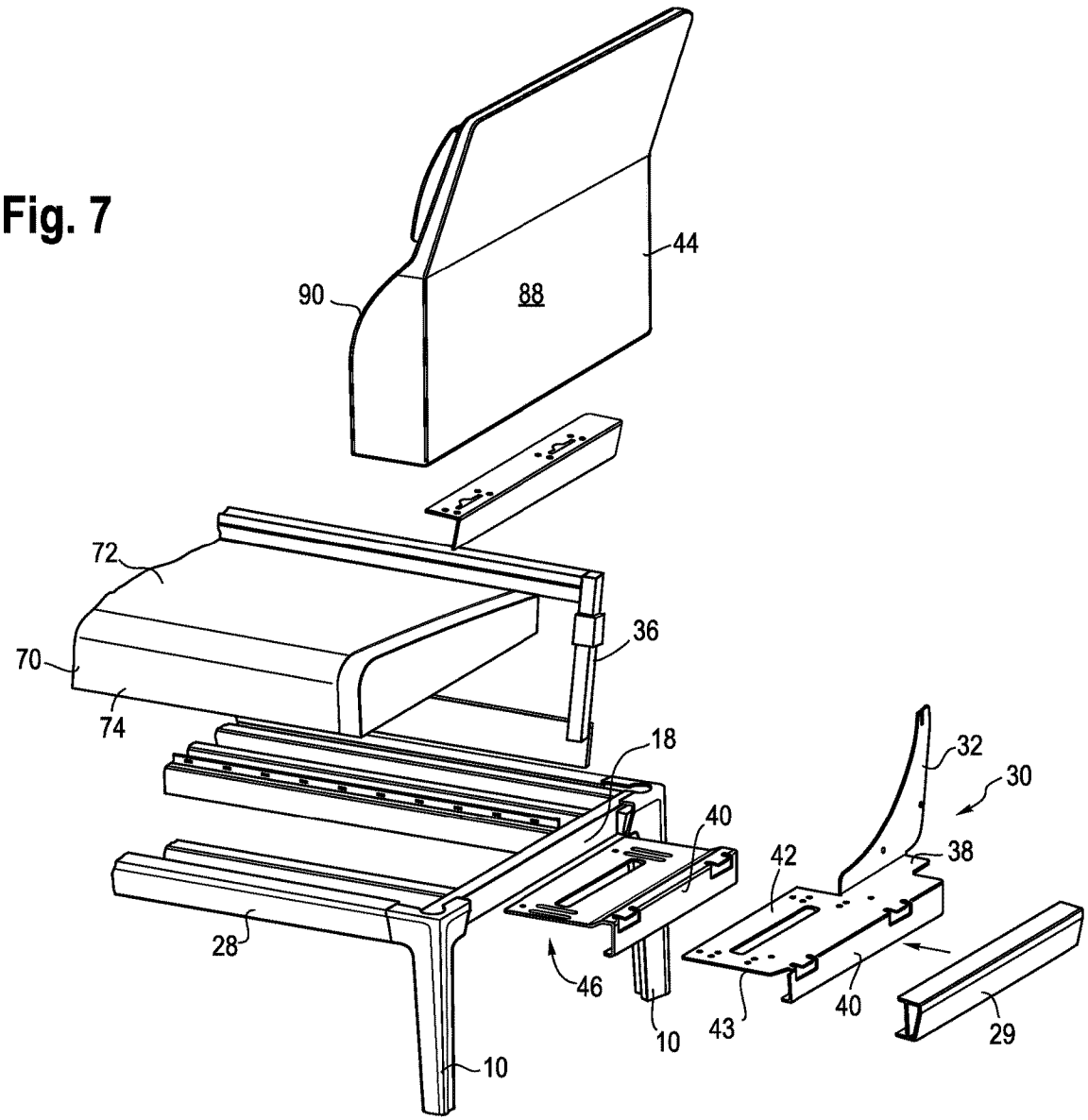
FIG. 7 is a partial, exploded view of one embodiment of a base.

The frame structure 8 includes inner frame members 11, 12, 14 and outer frame members 16, 18, with the inner frame members 11, 12, 14 and outer frame member 16 serving as beams connected along an intermediate location with cross members 20. The inner frame members 11, 12, 14 and outer frame members 16 are attached to outer side frame members 18 (e.g. by welding or mechanical fasteners) to form a frame structure capable of supporting the load of modules and components supported thereon. As shown in FIG. 6, the frame structure includes three inner frame members 11, 12, 14, with two inner frame members 12, 14 arranged to form a pair of spaces 21, 22 with a rear outer frame member 16, and one inner frame member 11 forming a space 24 with a front outer frame member 16.

The support structure includes four leg assemblies 10 to elevate and support the frame structure 8 above the floor. According to an exemplary embodiment, frame structure 8 is attached at corners to leg assemblies 10 with fasteners, shown as pins 26, in a clevis arrangement to form a suitable load-bearing structure for base.

Trim members 28, 29 are attachable to the base at the leg assemblies 10. According to an exemplary embodiment, the trim members serve multiple functions for the article of furniture, including to provide an aesthetic/ornamental appearance for the article of furniture and to secure modules or components to the base. The trim members 28, 29 when installed may also provide a degree of structural rigidification for the support structure and base frame assembly. According to one embodiment, during the construction of an article of furniture, in sequence the trim members will be attached to the base after the modules or components have been set into place on the base. The trim members are configured so that attachment of the trim members secures and holds certain types of modules and components to the base.

Figure 5:
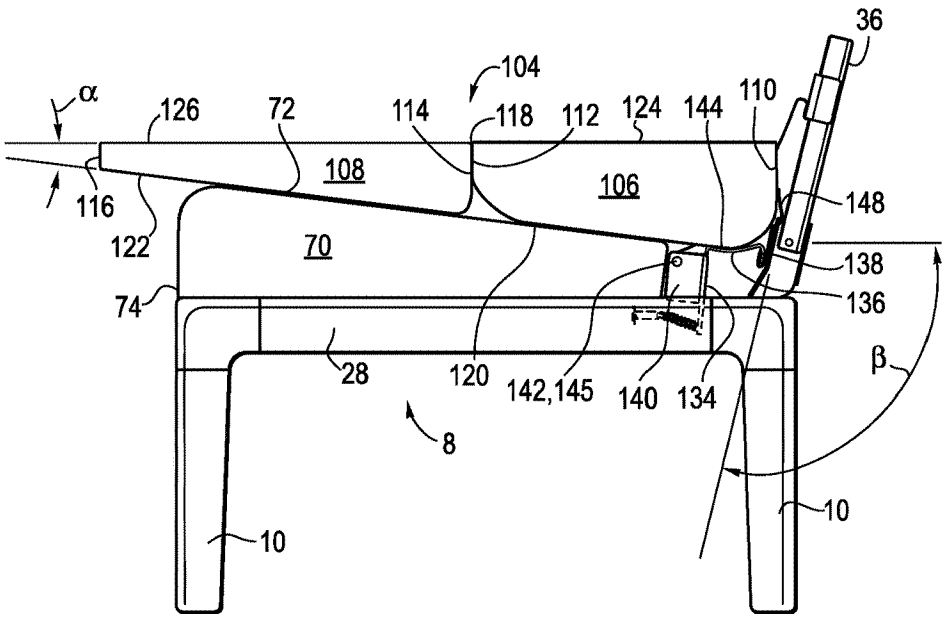
FIG. 5 is a cross-sectional view of the body support structure shown in FIG. 3 with the cushion in an unfolded, sleeping configuration.
Figure 4:
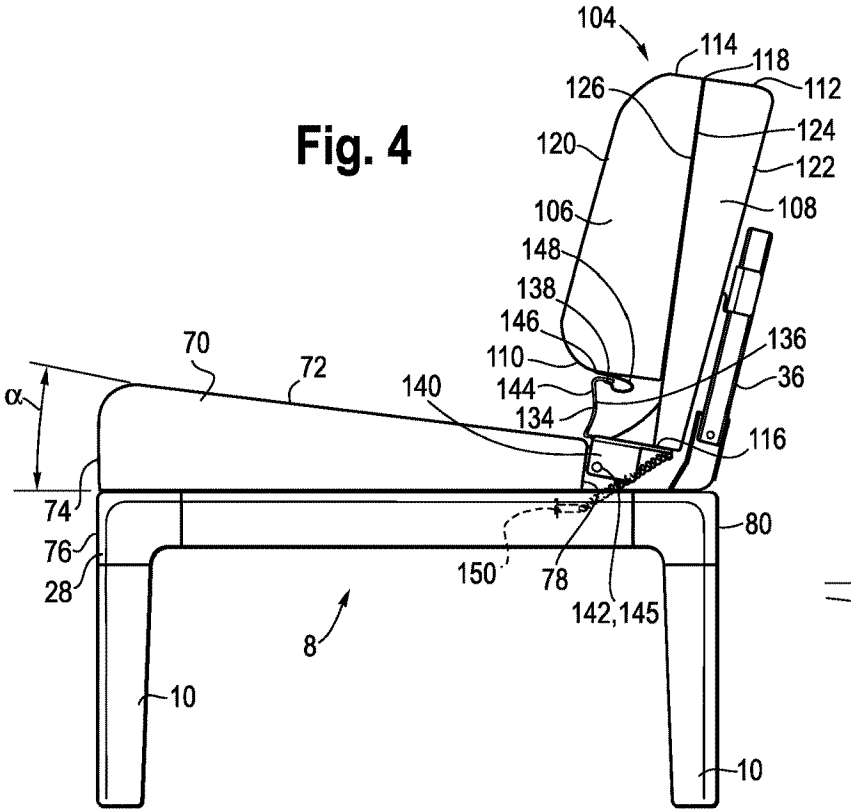
FIG. 4 is a cross-sectional view of the body support structure shown in FIG. 1, with the cushion in a folded seating configuration.
Figure 18:
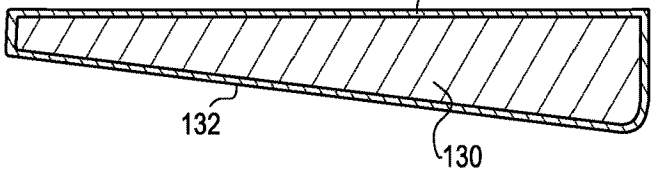
FIG. 18 is a cross-sectional view of one of the foldable cushion sections.

According to an exemplary embodiment, the members of the frame structure of the base are steel tubes that may be attached to form the frame structure by welding or other suitably secure mechanical fasteners. The trim members may be formed as an extrusion (e.g. of a rigid plastic or metal) configured for attachment to the leg assemblies. As shown in FIGS. 4-6, trim members 28, 29 and leg assemblies 10 provide readily visible exterior surfaces of base and may be designed and configured to present a desired aesthetic appearance for the article of furniture.

The members of the frame structure are configured to provide attachment areas for the modules and components (e.g. on and in between members 11, 12, 14, 16). As shown, according to an exemplary embodiment, in the formation and construction of the article of furniture, the frame structure is attached to the support structure (e.g. leg assemblies) to form the base, and modules or components are installed and supported on the base (e.g. on the frame structure), with the trim members then being attached to the base to secure certain of the modules and components to the base.

The base will have a standard size and configuration to construct articles of furniture from modular components. To extend the size of the base, a supplemental frame may be provided for the article of furniture. Attachment of supplemental frame to frame structure and within the support structure will allow the enlargement of base for configuration and construction of articles of furniture having a larger size (than on a standard base).

Referring to FIGS. 6-9, various bracket embodiments are shown for attaching and supporting components (e.g., an end table, backrest, armrest or cabinet) on the frame. In one configuration, a bracket 30 includes an upstanding dorsal fin structure 32, which is connected to a backrest frame 36 supporting a foldable cushion. The rear trim member 28 overlies and entraps a horizontal flange portion 38 extending rearwardly, with the flange 38 lying orthogonal to and immediately below the rear edge of the dorsal fin. The trim member 28 locks the bracket 30 firmly in place. The bracket 30 has a longitudinally extending channel 40 shaped to engage the side frame member 18, with the trim member 29 covering the channel. A web portion 42 of the bracket overlies and is supported by the frame members 11, 12, and has a front flange 43 that overlies frame member 16. The front trim member 28 captures and holds the flange 43 on the frame member 16. An armrest 44 may be coupled to the web portion 42.

Alternatively, a bracket 46 may be used to support an armrest 44 along an end of the seating structure. The bracket includes a channel 40 disposed over the side frame member 18 and captured by the trim member 30. Bracket 46 may be used in combination with bracket 50, shown in FIG. 8, which supports the backrest. In such an embodiment, the bracket 30 is omitted.

Figure 8:
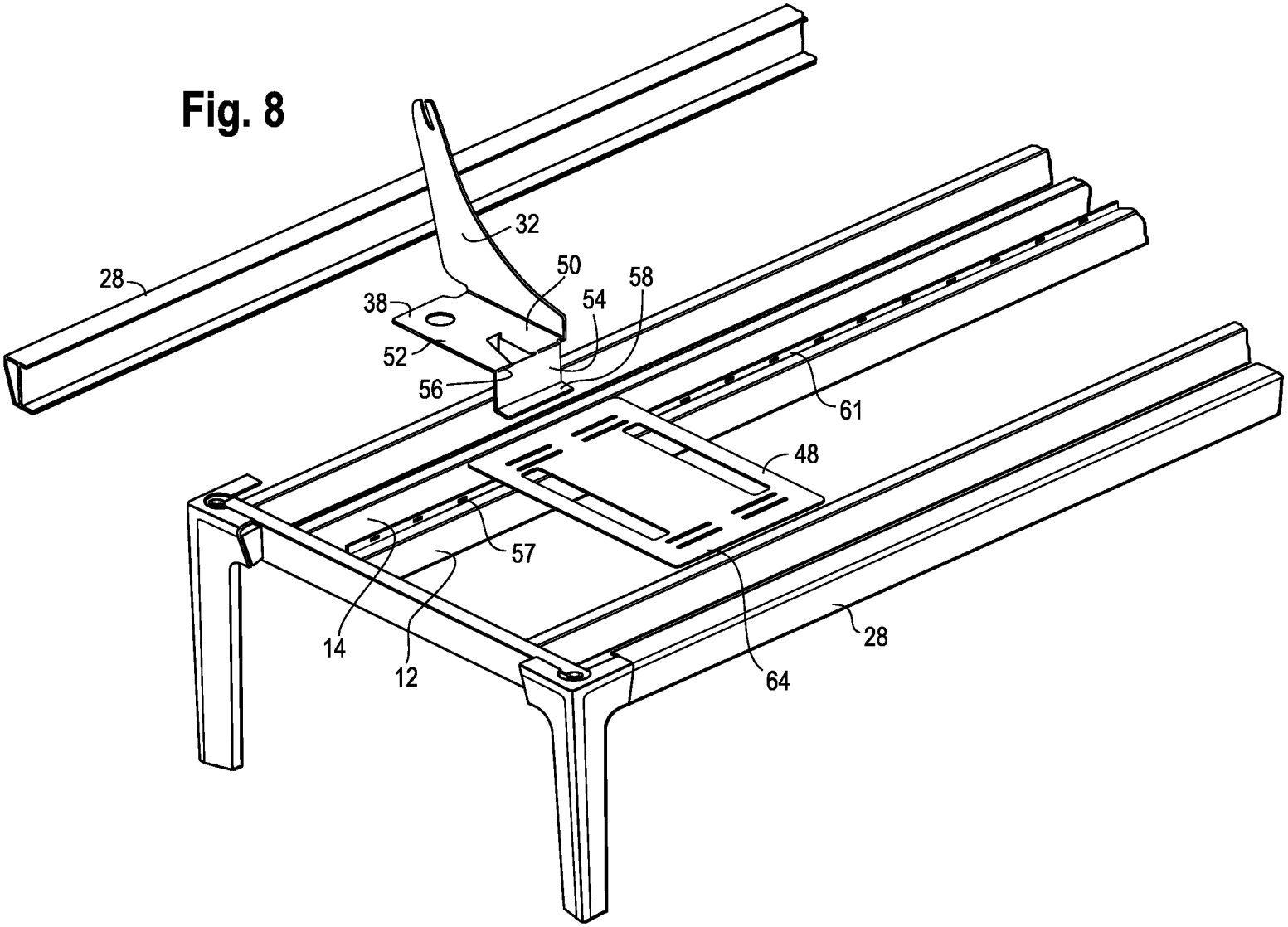
FIG. 8 is a partial, exploded view of another embodiment of a base frame
Figure 9:
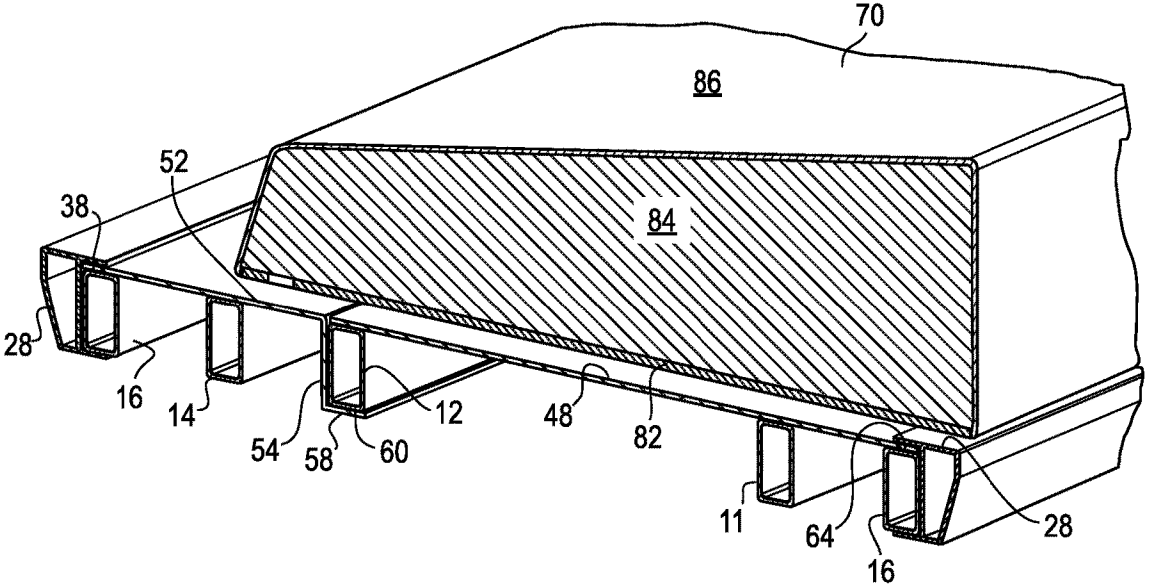
FIG. 9 is a cross-sectional view of one embodiment of a base supporting an armrest.

In another embodiment, shown in FIGS. 8 and 9, for example when an accessory such as an end cabinet or end table may be secured to the frame, one or more mid-run brackets 48, 50 are secured to the frame at various locations along the length of the frame to support the backrest and armrest. For example, the bracket 50 includes a dorsal member 32 extending upwardly from a horizontal base web 52, a rearwardly extending flange 38, and an L-shaped flange 54 extending forwardly from the base web. One or more tabs 56 may extend forwardly and be disposed in openings 57 formed in an upstanding flange 61 of the frame member 12. The L-shaped flange 54 has a bottom lip 58 that engages a bottom 60 of the second inner frame member 12, with a trim member engaging and securing the base web. A mid-run bracket 48 overlies the frame members, and has a front flange portion 64 engaged, or entrapped, by the front trim member 28. An armrest 44 and back frame 36 may then be secured to the brackets 48, 50.

Referring to FIGS. 4, 5 and 9, a seat cushion 70 defines a first body supporting surface 72, which is angled downwardly an acute angle $\alpha$ relative to a horizontal plane as the first body supporting surface extends rearwardly. The body supporting surface 72 may be crowned to help avoid fabric puddling, such that a is varied from the front to the back of the surface. In one embodiment, $\alpha$ is about 5 degrees at the front and 9 degrees at the back with a mean angle of 7 degrees. In various embodiments, $\alpha$ is between about 3 and 10 degrees. The seat cushion has a front end 74 substantially flush with the front of the frame 8, or the face 76 of the trim member 28 and leg 10, and a rear end 78 spaced inwardly, for example between 4 and 8 inches, and preferably about 6 inches, from the rear 80 of the frame 8. The seat cushion 70 may include a bottom support substrate 82, or rigid member, which may be secured to the frame 8 or one of the aforementioned brackets, for example with fasteners, and a cushion portion 84 disposed on and above the substrate. The cushion portion 84 may be made of foam, or other suitable material. A cover 86, such as a fabric, is secured over the cushion portion 84.

Armrests 44 are secured to the brackets 46, 48, 50 on opposite ends of the seat cushion. The armrests 44 have a substantially planar outer surface 88, and convexly curved inner surface 90, with an upper platform 92 to provide a support landing for the user's arm. In one embodiment, the upper platform 92 is flush with a platform 94 defined by the backrest frame 36, covered with a fabric 96. In one embodiment, an armrest 44' includes an elevated support portion 98, which defines a backrest for a user seated sideways on the seat cushion. The armrest 44' may include a pillow 100 coupled to or integrally formed with the elevated support portion 98. A top 102 of the elevated support portion is spaced above the platform 94 defined by the backrest, and the platform 92 defined by an opposite armrest. It should be understood that the body support structure may be configured with a pair of armrests 44' having opposing elevated support portions, or with a pair of armrests 44.

Folding Cushion

Referring to FIGS. 2-5 and 18, a foldable cushion 104 includes first and second sections 106, 108 each being tapered from a first end 110, 112 to a second end 114, 116, and having first and second sides 120, 122, 124, 126. The second end 114 of the first section 106 is hingedly or rotatably connected to the first end 112 of the second section 108 at a hinge 118, for example with an outer cover (e.g., a fabric material) that defines the second sides 124, 126 of the first and second sections 106, 108. Each of the first and second sections includes a support layer 128 proximal the second sides and a cushion layer 130 proximal the first sides, with one or more fabric layers 132 covering the support layer and cushion layer. In one embodiment, the cushion 104, or first and second sections 106, 108, is made with a molded urethane foam core and a ½ inch layer of viscoelastic (memory) foam support layer when in the unfolded configuration. The composite structure of the cushion further includes a layer of ¼ inch topper foam with a nylon slip surface to allow the fabric to rebound from compression. The outermost sleep surface is a water resistant fabric.

The first and second sections 106, 108 are moveable between a seating configuration and a sleeping configuration. In the seating configuration shown in FIGS. 1 and 4, the second sides 124, 126 are facing each other and the first sides 120, 122 are facing away from each other. The first end 110 of the first section is spaced above the first body support surface 72, and the first side 120 of the first section defines a forwardly facing body supporting surface for a back of the user. The first side 122 of the second section faces rearwardly and engages a front surface 135 of the backrest frame 36, which is covered with a fabric.

In the sleeping configuration shown in FIG. 5, the second sides 124, 126 of the first and second sections are facing upwardly and define a second body support surface which is substantially planar. Preferably, the sections are tapered with the first sides angled downwardly at an acute angle $\alpha$ relative to a horizontal plane when the sections 106, 108 are in the sleeping configuration. The first sides 120, 122, including the body support surface of the first section, are facing downwardly and are supported on the body support surface 72 of the seat cushion 70. Due to the mating tapered angles $\alpha$ of the seat cushion and the first and second sections, the second body support surface is substantially horizontal when the first and second sections 106, 108 are in the sleeping configuration. In this way, the first and second sections provide an appropriately oriented sleeping surface for the user. Also, due to the rearwardly inclined interface between the tapered surfaces 72, 120, 122, the first and second sections are biased by gravity toward the backrest 36 when supporting the user, and are inhibited from moving forwardly. In this way, the position of the folding cushion on the seat cushion 70 and frame structure 8 is maintained and ensured. The second end 116 of the second section 108 may be flush with the end 74 of the seat cushion, or may extend outwardly therefrom as shown in FIG. 5.

Referring to FIGS. 4 and 5, a spacer 134 includes a web 136 defining a first support surface 144 and a flange 138 defining a second support surface 146. The web and flange may be curved to mate with corresponding surface contours of the first section 106. In one embodiment, the first and second support surfaces 144, 146 are transverse to each other, or define an angle $\beta$. The angle $\beta$ may be between 102.5 and 103.5 degrees, and preferably about 103 degrees. In one embodiment, the spacer extends in a lateral direction along the length of the backrest, and may be configured with a C-shape cross section. Opposite ends of the spacer include a pivot flange 140 extending downwardly from the bottom of the spacer. The pivot flanges 140 are pivotally coupled to the base frame 8 about a longitudinal pivot axis 142, for example with a hinge member 145. The hinge member may be configured as a hinge pin, or may be configured as a living hinge or linkage mechanism.

The spacer 134 is pivotal between an upright position (FIG. 4), wherein the second support surface 146 engages and supports a first end 110 of the first section 106 of the cushion in the seating configuration, and a down position, wherein the first support surface 144 engages and supports the body supporting surface, or first side 120, of the first section 106 in the sleeping configuration. A tether 148, such as a flexible lanyard, is coupled between the spacer 134 and the first section 106 of the cushion. In one embodiment, the tether 148 is connected between the flange 138 and the first end 110 of the first section 106. A spring 150 is coupled between the frame and the spacer, and biases the spacer to the down position. The spring may be a tension spring acting on the spacer, or may be a torsion spring arranged along the pivot axis 142, for example connected to the hinge member 145.

Figure 3:
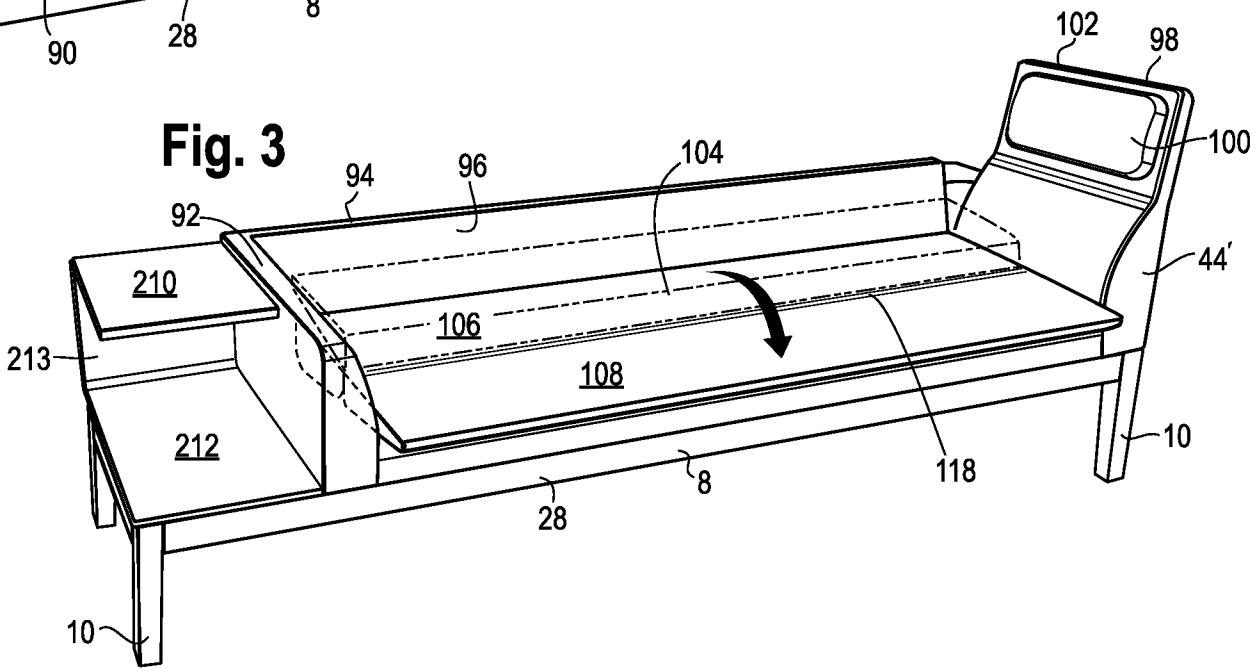
FIG. 3 is a perspective view of the body support structure shown in FIG. 1 with the cushion in an unfolded, sleeping configuration.

In operation, the body supporting structure may be easily and quickly converted from a seating configuration to a sleeping configuration. Referring to FIGS. 2 and 3, the user pulls the cushion 104 forwardly, with the tether 148 anchoring the first section 106 of the cushion. As the first section 106 rotates, the spacer 134, assisted by the spring 150, rotates rearwardly (shown clockwise in FIGS. 4 and 5) from the upright position to the down position, pulling the first end 110 of the first section rearwardly, as shown in FIG. 5. At the same time, the second section 108 clears the backrest frame 36 and can be rotated by the user about the hinged connection 118 such that the first sides 120, 122 rest on the body supporting surface 72 of the seat cushion. In this sleeping configuration, the second sides 124, 126 of the first and second cushions provide an upwardly oriented, and substantially horizontal, body supporting surface.

To return the cushion to the seating configuration, the user simply lifts and rotates the second section 108 until it overlies the first section 106, with the second sides 124, 126 in contact. The user then rotates the folded cushion rearwardly, with the tether 148 pivoting or rotating the spacer 134 upwardly (counter clockwise in FIG. 5) against the force of the spring 150 until the spacer 134 is returned to the upright position. In the upright position, the spacer supports the first end 110 of the first section and maintains the first section above the body supporting surface 72 of the seat cushion.

Accessories

Referring to FIGS. 1-3 and 10-16, various accessories may be coupled to the base and/or armrests. The accessories may include without limitation a table or table, a canopy, storage, a tray, a light, and/or a hook.

Table

Figure 12:
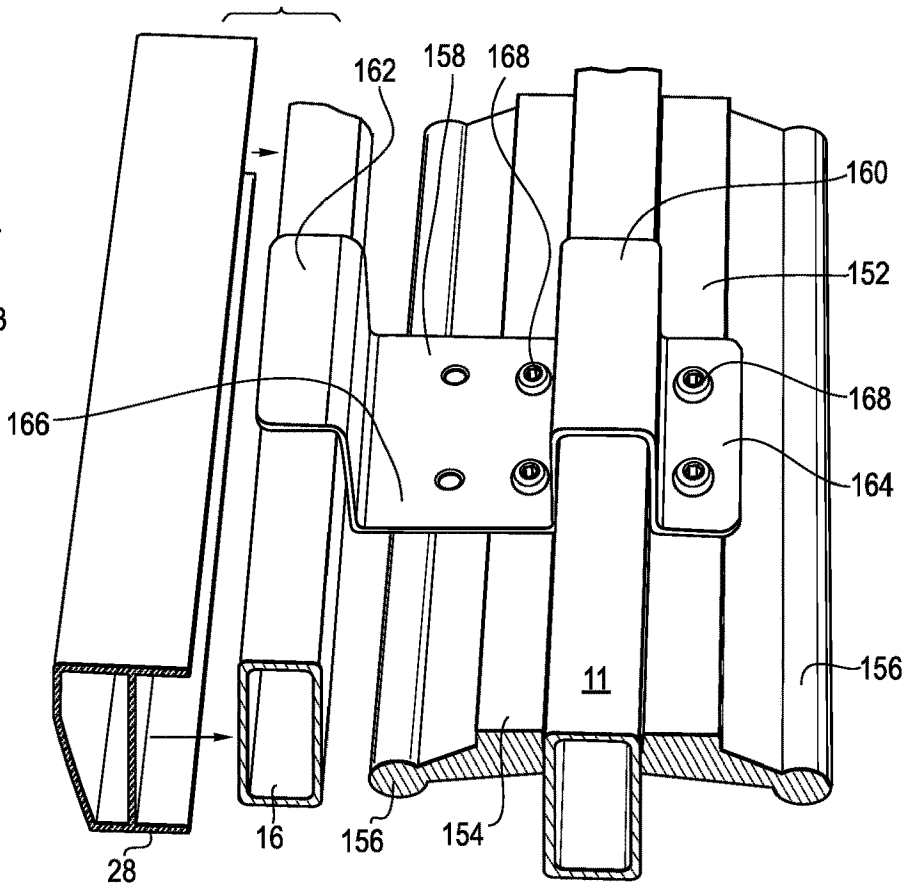
FIG. 12 is a partial perspective view of one embodiment of a rail member coupled to a frame.
Figure 11:
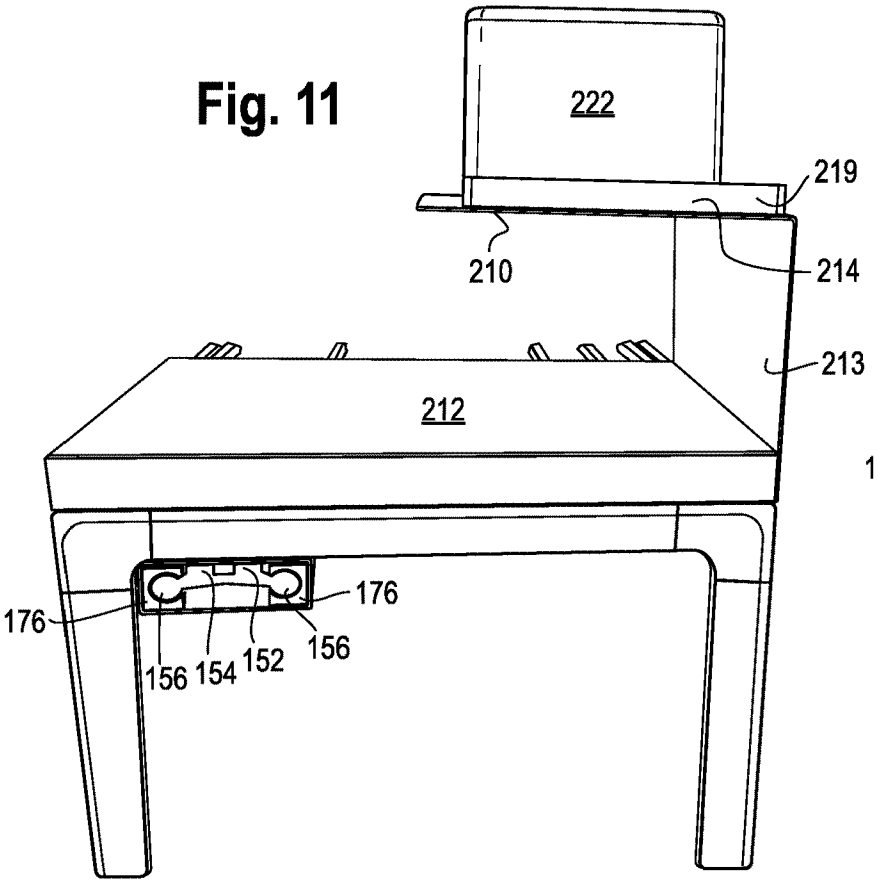
FIG. 11 is a partial view of a frame supporting a rail coupled to the base frame.
Figure 13:
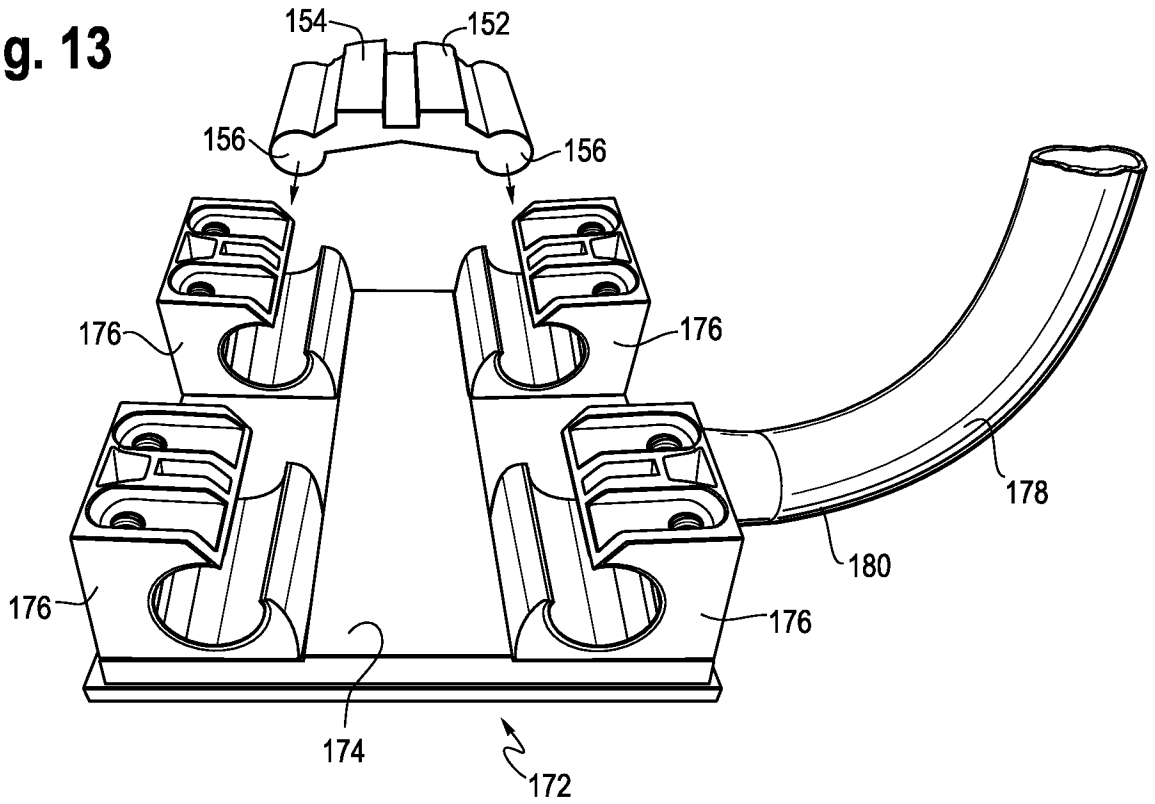
FIG. 13 is a perspective view of one embodiment of a table base configured with guides.
Figure 15:
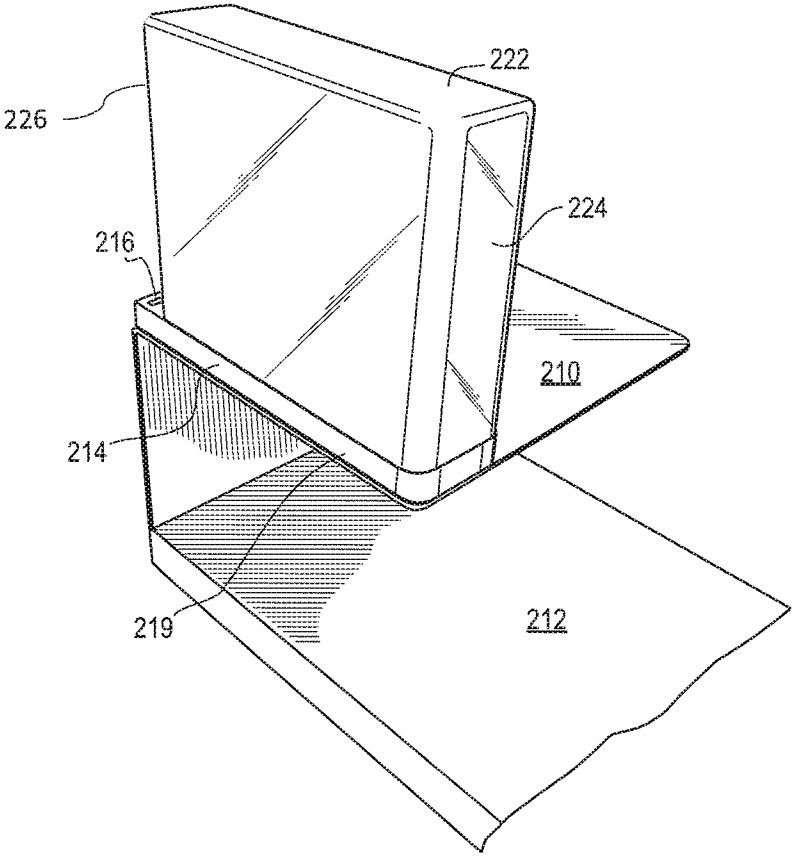
FIG. 15 is a perspective view of a light supported on the side table of FIG. 14.
Figure 14:
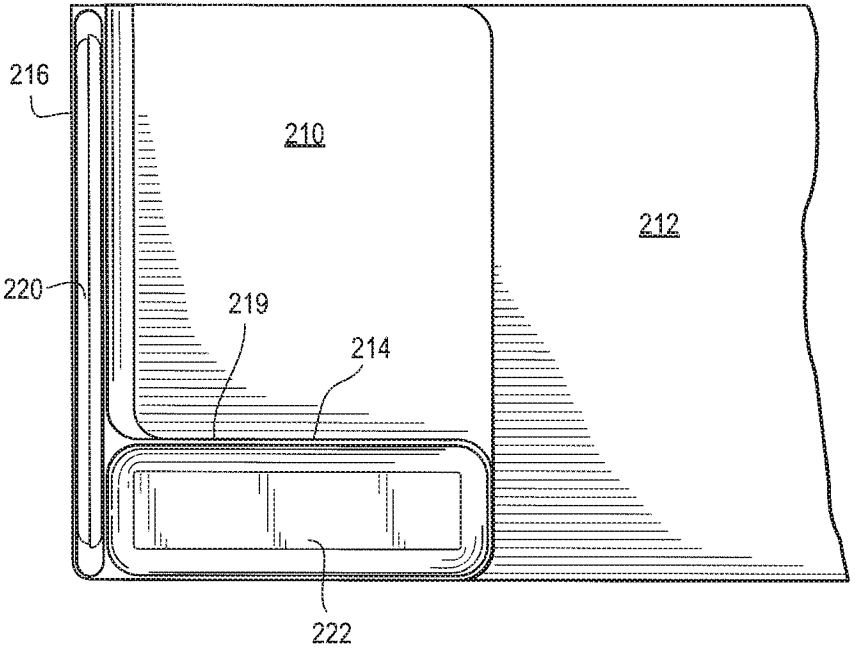
FIG. 14 is a plan view of a side table.

Referring to FIGS. 1 and 11-13, a rail member 152, having a central mounting portion 154 and a pair of laterally spaced apart side rails 156, is mounted under the inner frame member 11. For example, as shown in FIG. 12, a bracket 158 has a U-shaped support portion 160 fitting over the inner frame member 11 and a flange fitting 162 over the outer frame 16, with the flange captured by the front trim member 28. The rail member 152 is disposed under and secured to a pair of support flanges 164, 166, for example with fasteners 168, beneath the frame member 11.

The rail member 152 may be formed as an extrusion (e.g., metal or plastic), or by combining a pair of side rails, for example by welding or fasteners. The side rails 156 each have an elliptical cross section, for example a circular cross section. The rail member may extend along the entire length of the frame structure, or along only a portion thereof depending on the desired length of travel for a corresponding table 170.

The table 170 includes a carriage 172 having a plate 174 and a plurality of guides 176. The plate and guides may be integrally formed, or joined for example by welding. The plate 174 is disposed beneath the rail member 152, with spaced apart guides 176 encircling and capturing the side rails 156. The guides may be configured as C-shape blocks, having a low coefficient of friction liner, such as plastic, which interfaces with the side rails. The side rails may also be configured with an outer layer of low coefficient of friction material. The guide/rail interface may also be configured with a roller or ball bearing structure.

Figure 22:
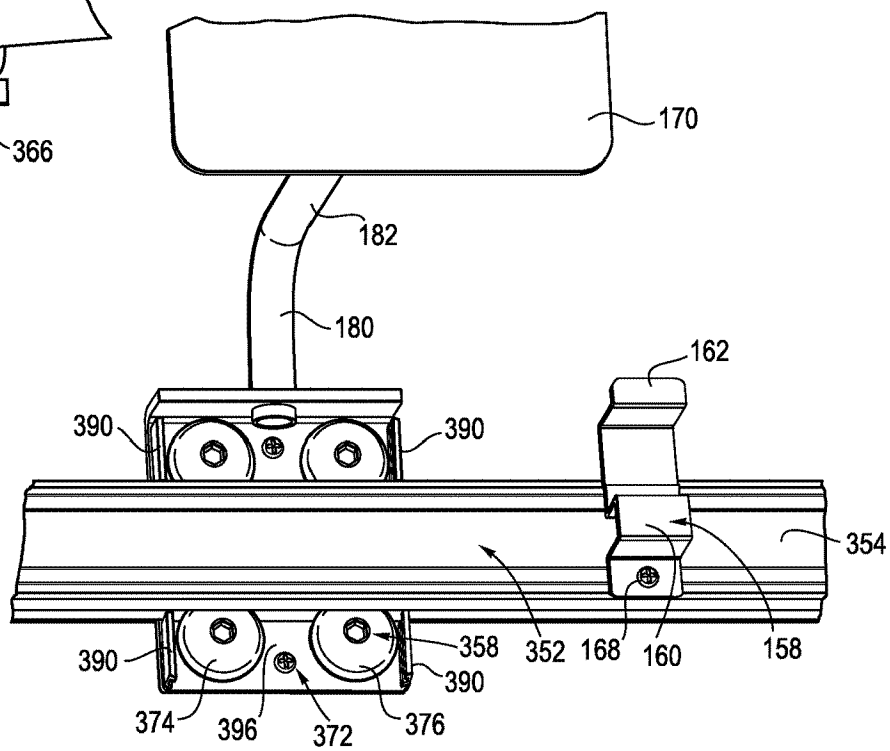
FIG. 22 is a partial top view of the rail and carriage shown in FIG. 21.
Figure 21:
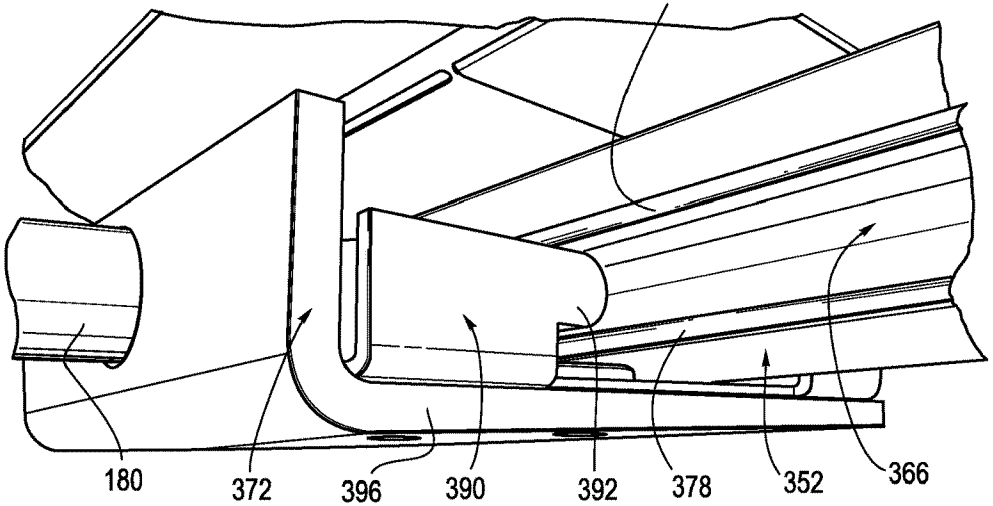
FIG. 21 is a partial perspective view of another embodiment of a rail member coupled to a frame and supporting a table carriage.

Referring to FIGS. 21 and 22, an alternative embodiment of a rail member 352 has a central mounting portion 354 and a pair of laterally spaced tracks 366, configured in one embodiment as outwardly facing concave shaped grooves, on opposite sides of the rail. The rail is mounted under the inner frame member 11. For example, as shown in FIG. 22, a bracket 158 has a U-shaped support portion 160 fitting over the inner frame member 11 and a flange fitting 162 over the outer frame 16, with the flange captured by the front trim member as described above. The rail member 352 is disposed under and secured to a pair of support flanges 164, 166, for example with fasteners 168, beneath the frame member 11.

The rail member 352 may be formed as an extrusion (e.g., metal or plastic), or by combining a pair of side rails, for example by welding or fasteners. The rail member may extend along the entire length of the frame structure, or along only a portion thereof depending on the desired length of travel for a corresponding table 170.

The carriage 372 has a plate 396 and includes a body, configured in one embodiment as a plate 396. The carriage has two sets of spaced apart wheels 358 rotatably coupled to the plate, with each set of wheels disposed in and engaging one of the tracks 356. The wheels 358 rotate about four spaced apart vertical axes, or axes extending perpendicular to the rail. In other embodiments, the axes may be angled relative to each other. The grooves on the rails have a sufficient depth such that upper and lower "lip" portions 370, 378 of the rails overlap the wheels (e.g., 5 mm). In operation, the wheels roll along the tracks, but the upper and lower surfaces 374, 376 of the wheels also slide along the overlapping portions 370, 378 of the tracks. When loaded, the sliding interface creates friction that prevents the carriage 372 from moving as easily as when unloaded. It should be understood that the term "slidingly" refers to movement of the carriage relative to the rail, including a rolling interface of the wheels in the tracks and/or a sliding interface between the wheels and the track or a sliding of guides on the side rails.

In addition, the carriage 372 body is provided with guards 390 positioned at each end of the carriage. The guards are configured with fingers 392 that protrude into the grooves of the track 366 without engaging the tracks. The fingers 392 have a curved end portion, which is shaped (e.g., convex) to be received in, and match the profile of, the groove but dimensioned to leave a minimal space between the edge of the finger and the surface of the groove. In one embodiment, the spacing between the edge of the finger and the surface of the groove is uniform along the interface of the profile there between. The fingers 392 block and eliminate pinch points between the wheels 358 and tracks 366. The fingers 392 also function as an anti-dislodgment device, engaging the tracks 366 (e.g., the lips 370, 378) and preventing the carriage 372 from being disengaged from the rail 352 under extremely high loads (e.g., applied to the table) in a non-dislodgement condition, with the fingers remaining spaced from the groove in a normal operating condition. The fingers 392 additionally improve the aesthetics of the carriage. The guards 390 may be made of metal so as to provide increased strength to prevent dislodgement, or may be made of plastic.

An upright 178 includes a transverse portion 180 coupled to the carriage plate 174, 396 and an upright portion 182 extending upwardly from the transverse portion in front of the frame 8. The upright portion 182 extends upwardly above the body supporting surface 72 of the seat cushion 70. The upright may be made of a metal tube, such as steel or aluminum.

Figure 10:
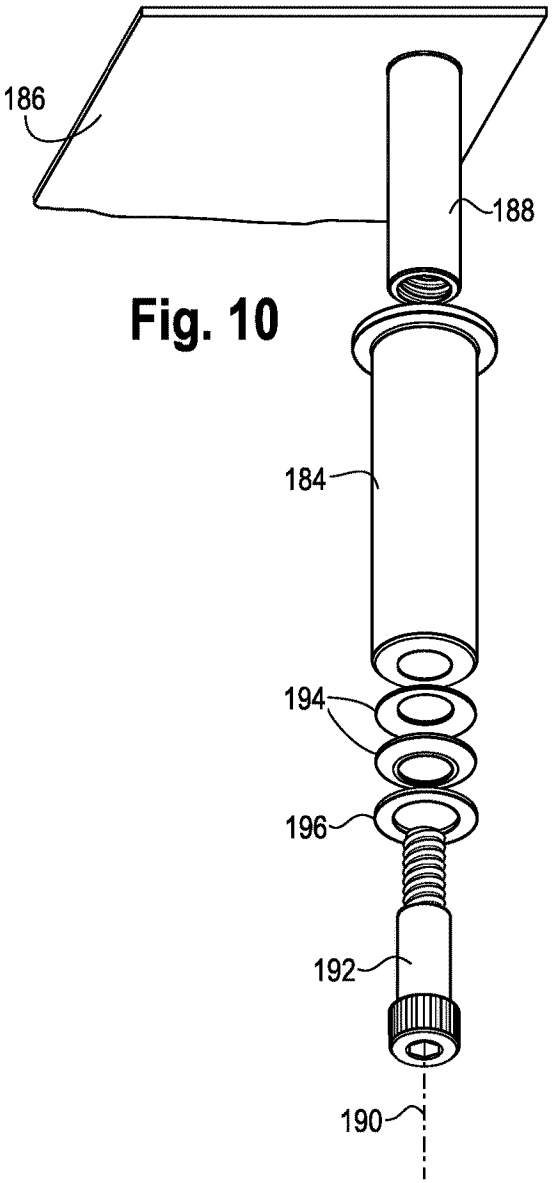
FIG. 10 is an exploded perspective view of one embodiment of a table.

Referring to FIG. 10, an injection molded pivot bushing 184 is press fitted into the top of the upright portion 182. A table includes a worksurface member 186 having a downwardly extending pivot pin 188. The pivot pin is inserted into the pivot bushing and is free to rotate about an axis 190 defined by the bushing and pin. A shoulder bolt 192 extends through one or more standard and Belleville washers 194, 196 and the bottom of the pivot bushing 184. The bolt 192 threadably engages the bottom end of the pivot pin 188 and rotatably secures the pin to the bushing.

In operation, the user may rotate the table 360 degrees about the pivot axis 190 defined by the pivot pin. In addition, the user may slide (or roll) the table 170 along the front of the body supporting structure as the carriage 172 slides (or rolls) along the rail member 152. The table may be quickly and easily moved to the end of the body supporting structure such that it does not interfere with users seated thereon, or may be moved to any position along the rail so as to provide a worksurface for the user, for example to support a computer, mobile device, writing table, etc.

Canopy

Figure 19:
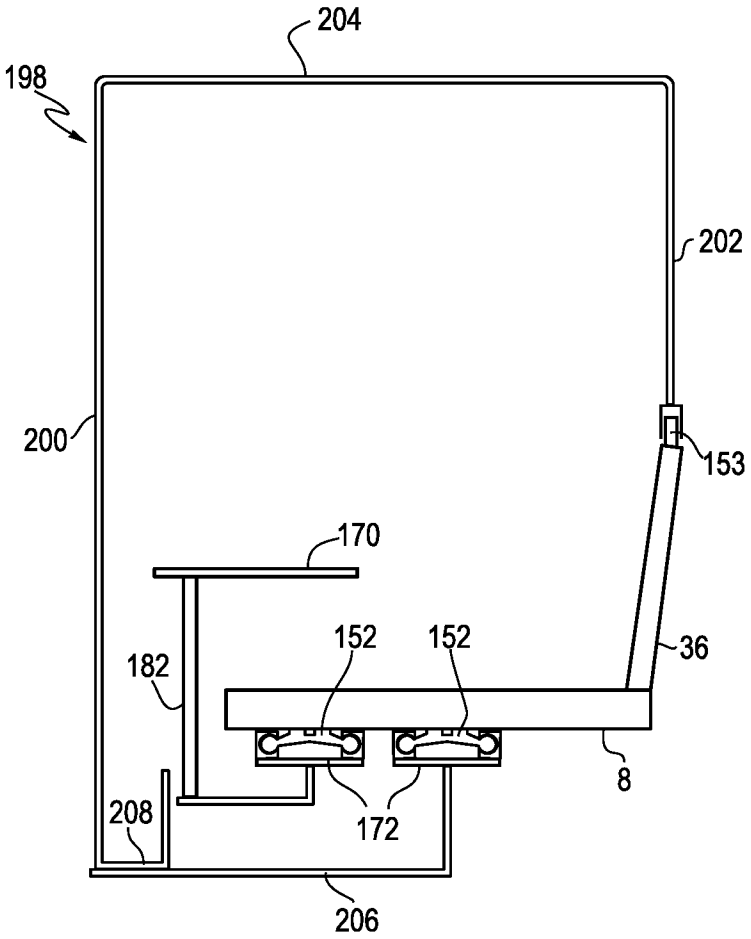
FIG. 19 is a schematic cross section showing a canopy and table slidably supported by a frame.

In one embodiment, and referring to FIGS. 1 and 19, a second rail 152 may be secured to the frame similar to the rail supporting the table. A third rail 153 may be secured to the back frame 36, or to the frame adjacent the rear thereof. A canopy 198 has an inverted U-shape, with front and rear walls 200, 202 and a ceiling portion 204 connected therebetween. Each of the front and rear walls includes a mounting portion, or carriage 172, (e.g., with guides, rollers, etc.) that engages and moves along the second and third rails 152,153. The canopy may include one or more shelves 206 (which may function as a table or worksurface) that extend between the front and rear walls, or between the front wall 200 and the front of the frame structure 8. The canopy may be translated to different positions overlying the body support structure. A bottom transverse member 208 may be positioned lower than the carriage 172 of the table upright, such that there is clearance there between as shown in FIG. 19, with the front wall 200 also extending forwardly, or being spaced from the frame 8, a greater amount than the table 170. In this way, a first component, e.g., the table 170, and a second component, e.g., a canopy 198, may be independently moved, e.g., translated or slid, past each other to various desired positions along the front of the body supporting structure, such as a sofa of chair (or along the side of a bed), without interference from the other component. It should be understood that the first and second components may both be tables, for example at the same or different heights. It also should be understood that the first and second components may be configured as user interfaces or structures other than the disclosed table and canopy, including various storage components (e.g., cabinets, tables, etc.) or body support elements (e.g., foot or arm rests), or may include one or both of the table or canopy combined with each other or with other such components.

Storage and Light

Figure 16:
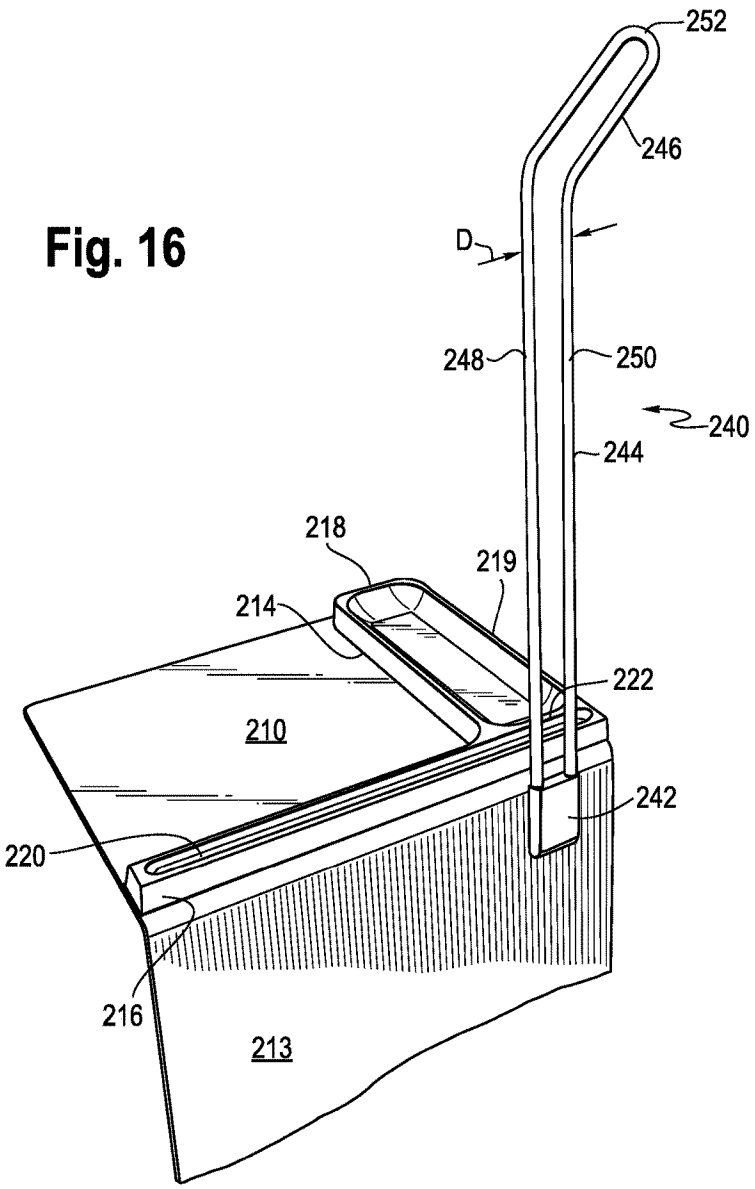
FIG. 16 is a view of a hook coupled to the side of a body support structure.

Referring to FIGS. 1, 11, and 14-16, a storage unit includes upper and lower shelves 210, 212 connected with a rear wall 213 and supported by the frame 8 adjacent one of the armrests 44, 44'. The upper shelf 210 is shorter than the lower shelf 212, and is cantilevered over the lower shelf with a vertical spacing therebetween. In one embodiment, an accessory tray 214 is disposed on the shelf 210, and may be secured thereto with fasteners, whether mechanical or adhesive. The tray 214 has an L-shape, with a narrow groove 220 formed in one leg 216 of the tray and running along a rear edge of the tray, and a larger recess 218 running along the other leg 219 of the tray from the front to back thereof. In one embodiment, the groove and recess are spaced apart by a landing portion. In one embodiment, the tray has a length and width equal to the width and length of the upper shelf 210 as shown in FIG. 16. Various personal accessories, including without limitation writing utensils, paper clips, keys, etc. may be stored in one or both of the groove and recess. In one embodiment, the recess 218 serves as a base for a light 222.

In one embodiment, the light 222 is a circadian rhythm light configured with a housing 224. The housing includes a base shaped be received in the recess 218, and an upper portion 226, which is configured as an opaque shade. The housing forms an interior cavity. A light source is disposed in the interior cavity of the housing. In various embodiments, the light source is a multi-color light emitting diode (LED) array configured to illuminate various individual LEDs of the array different combinations and intensities to produce visible light of different colors, hues, or color temperatures. The LED array may be altered to change the illumination of the various LEDs to dynamically change the color temperature of the light that is produced by the LED array. A diffuser or other structure may be included as part of the LED array to mix or scatter the colors from the individual LEDs to produce the visible light of the appropriate color temperature. Example light sources having an LED array may include Philips HUE® light bulbs.

In another embodiment, multiple different types of light sources may be included and may be selectively dimmed or altered and mixed to produce light of varying color temperatures. For example, one light source may have a cooler white light (e.g., a fluorescent light, a High Intensity Discharge (HID) light, or an LED having a cool white light) while a second light source may have a warmer white light (e.g., an incandescent light, a halogen light, or an LED having a warmer white light). As such, for example when using only white LEDs, one may be set at the lowest color temperature and another set at the highest color temperature. Other light source types are possible, and more than two light sources or light source types may be used in a similar manner. The intensities of the two (or more) light sources may be altered relative to one another to achieve a light mixture having an overall desired color temperature.

As discussed herein, color temperatures may be expressed in terms of Kelvin (K), with differing Kelvin color temperatures representing different hues of light. For example, color temperatures between 2000K and 3000K may include a yellow or red hue and may be considered "warmer" white light (e.g., candle light or incandescent light), while color temperatures over 5000K may include bluish tones and may be considered "cooler" white light. However, some color temperatures as low as 3000 k may have a bluish tone, while color temperatures at 5000 k may exhibit a very blue light. Other demarcation points along the color temperatures scale may be appropriate and the above "warm" and "cool" segments are merely examples.

Figure 20:
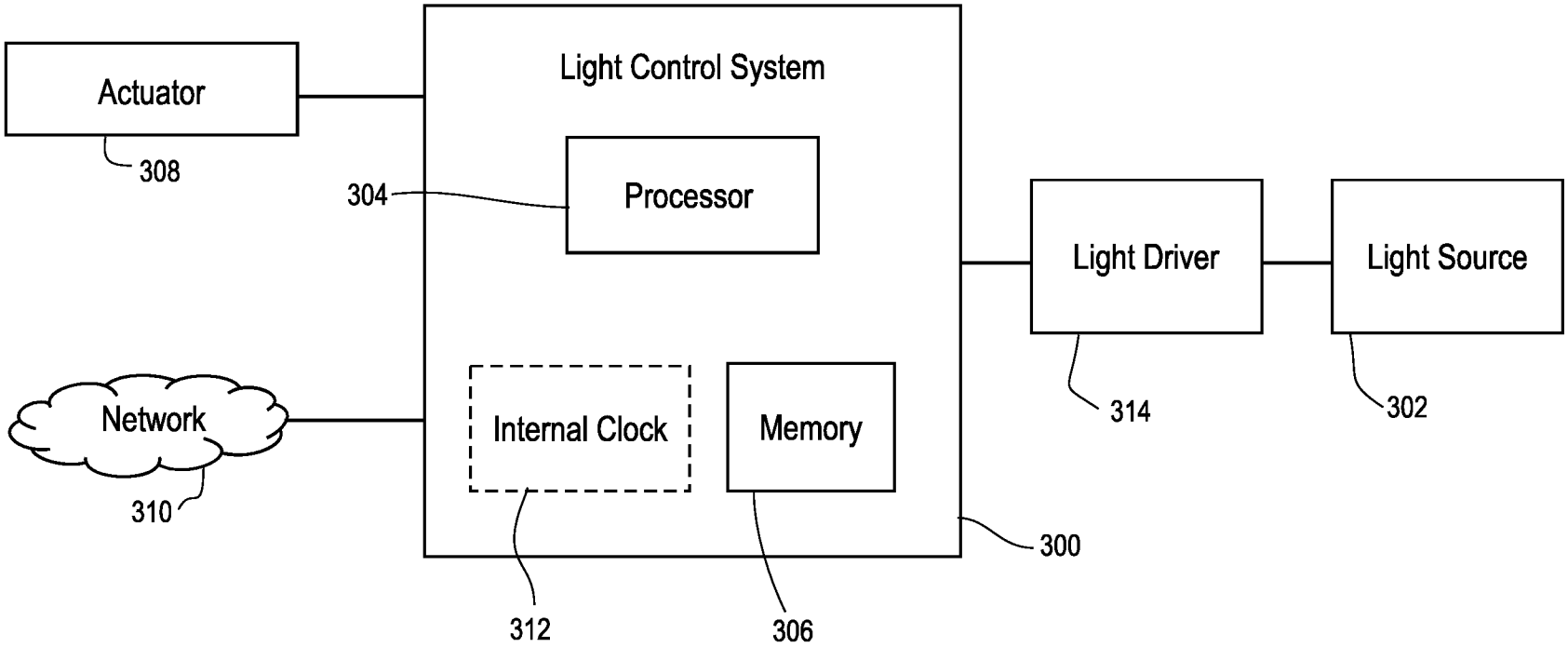
FIG. 20 is a block diagram for a light control system.

Referring to FIG. 20, a light control system 300 for the light source 302 includes a processor 304 and a memory 306. The light control system 300 may be coupled to or include an actuator 308, such as an on/off switch, a knob, a button, a dimmer switch, a touch screen control, a capacitive switch or another actuator control device. The actuator 308 may control the light control system to turn the light source on or off, to change the intensity (e.g., dimmer or brighter), and/or to change the color or color temperature of the light output by the light source 302.

Alternatively or additionally, the light control system 300 may be coupled to a network 310 such that the light control system 300 may be connected to other systems or devices and may receive instructions to control the light control system 300 via the network (e.g., from a central server or from a wireless mobile device operated by a user). The light control system 300 may include communication interface circuitry which may support wired or wireless communications via the network 310. Example wired communication protocols may include Ethernet, Gigabit Ethernet, asynchronous transfer mode protocols, passive and synchronous optical networking protocols, Data Over Cable Service Interface Specification (DOCSIS) protocols, EPOC protocols synchronous digital hierarchy (SDH) protocols, Multimedia over coax alliance (MoCA) protocols, digital subscriber line (DSL) protocols, cable communication protocols, or other networks and network protocols. Example wireless communication protocols may include Bluetooth, Wireless Fidelity (Wi-Fi), Wireless Local Area Network (WLAN), near field communication protocols, cellular protocols (2G, 3G, 4G, Long Term Evolution (LTE) Long Term Expansion Advanced (LTE-A)), or other wireless protocols.

The light control system may connect with central backend systems via the network 310 to enable remote control or central control of the light source 302. Additionally, the light control system 300 may communicate status and usage data to the central backend systems, including a current operational status of the light control system (e.g., on, off, brightness, color temperature, damaged, operational hours of light source, etc.).

The light control system 300 may be coupled to a time/date source that may provide the light control system 300 with the present time and/or date. Alternatively, the light control system 300 may receive periodic updates of the time or date from the source 312. The time/date source may be coupled to the light control system 300 via the network 310 or the network interface circuitry discussed above. Example time/date sources 312 include server-originated date and time signals, date and time server inquiry responses, GPS date and time signals, or other known date and time sources. For example and without limitation, the National Institute of Standards and Technology (NIST)) radio broadcast time signal may be used to set the clock. Alternatively, the light control system may include an internal clock 312 that may be programmed with the current the date and time and may continuously keep track of the date and time. A user may set the date and time manually (e.g., through the actuator 308 or other control mechanism), or the light control system 300 may receive the date and time automatically from other sources discussed above.

In one embodiment, the light control system 300 may interface or communicate with a light driver 314. The light driver 314 may receive signals from the light control system 300 and may translate those signals into other signals to control the light source 302. For example, the light driver 314 may receive digital signals from the light control system 300 including values relating to the brightness and/or color temperature of the light which the light source 302 should be set to. In one particular embodiment, the digital signals include DMX protocol lighting signals to control the aspects of the light. In another embodiment, the digital signals are in another format that include such data as overall intensity or brightness, color temperature, color, or other lighting aspects. The light driver 314 may, responsive to such signals, implement the proper control of the light source 302 to achieve such desired lighting settings. For example, if the light source 302 is an LED array, the light driver 314 may determine which LEDs should be illuminated and to what intensity to achieve the desired light intensity and/or color temperature. In one embodiment, the light driver 314 is integrated with the light source 302 (e.g., in a singular body such as a light bulb or other light device) rather than a separate device. In another embodiment, the light driver 314 is integrated with the light control system 300.

The processor 304 may include or be connected to the memory 306. The memory 306 may store control instructions, operational parameters for the control instructions, datasets, and other information. The control instructions may be executed by the processor 304 to implement any of the processing described herein. Further, in other embodiments, the memory 306 may store a lookup table or other datasets to cross reference times of day and/or dates to color temperatures and intensity (brightness) and/or changes in color temperatures and intensity. One example of such a look up table is illustrated below in Table 2. The processor 304 may access the lookup table and determine, based on the data within the lookup table, the current date, and/or the current time, the appropriate color temperatures at which the light source 302 should be set. In other embodiments, the memory 306 may store therein algorithms or mathematical formulas that can be implemented or accessed by the processor 304 to determine an appropriate color temperature at which the light source 302 should be set. Such algorithms may tie the color temperature of the light source 302 to the current time of day and/or the current date.

The processor 304 may be implemented with any know type of processor such as a Central Processing Unit (CPU), a microcontroller, or a microprocessor; or as an Application Specific Integrated Circuit (ASIC), Programmable Logic Device (PLD), or Field Programmable Gate Array (FPGA); or as circuitry that includes discrete logic or other circuit components, including analog circuit components, digital circuit components or both; or any combination thereof. The circuitry may include discrete interconnected hardware components or may be combined on a single integrated circuit die, distributed among multiple integrated circuit dies, or implemented in a Multiple Chip Module (MCM) of multiple integrated circuit dies in a common package, as examples. The memory 306 may include one or more non-transitory computer-readable mediums that may include a tangible storage medium that is other than a transitory signal, such as a flash memory, a Random Access Memory (RAM), a Read Only Memory (ROM), an Erasable Programmable Read Only Memory (EPROM); or on a magnetic or optical disc, such as a Compact Disc Read Only Memory (CDROM), Hard Disk Drive (HDD), or other magnetic or optical disk; or in or on another machine-readable medium.

Figure 17:
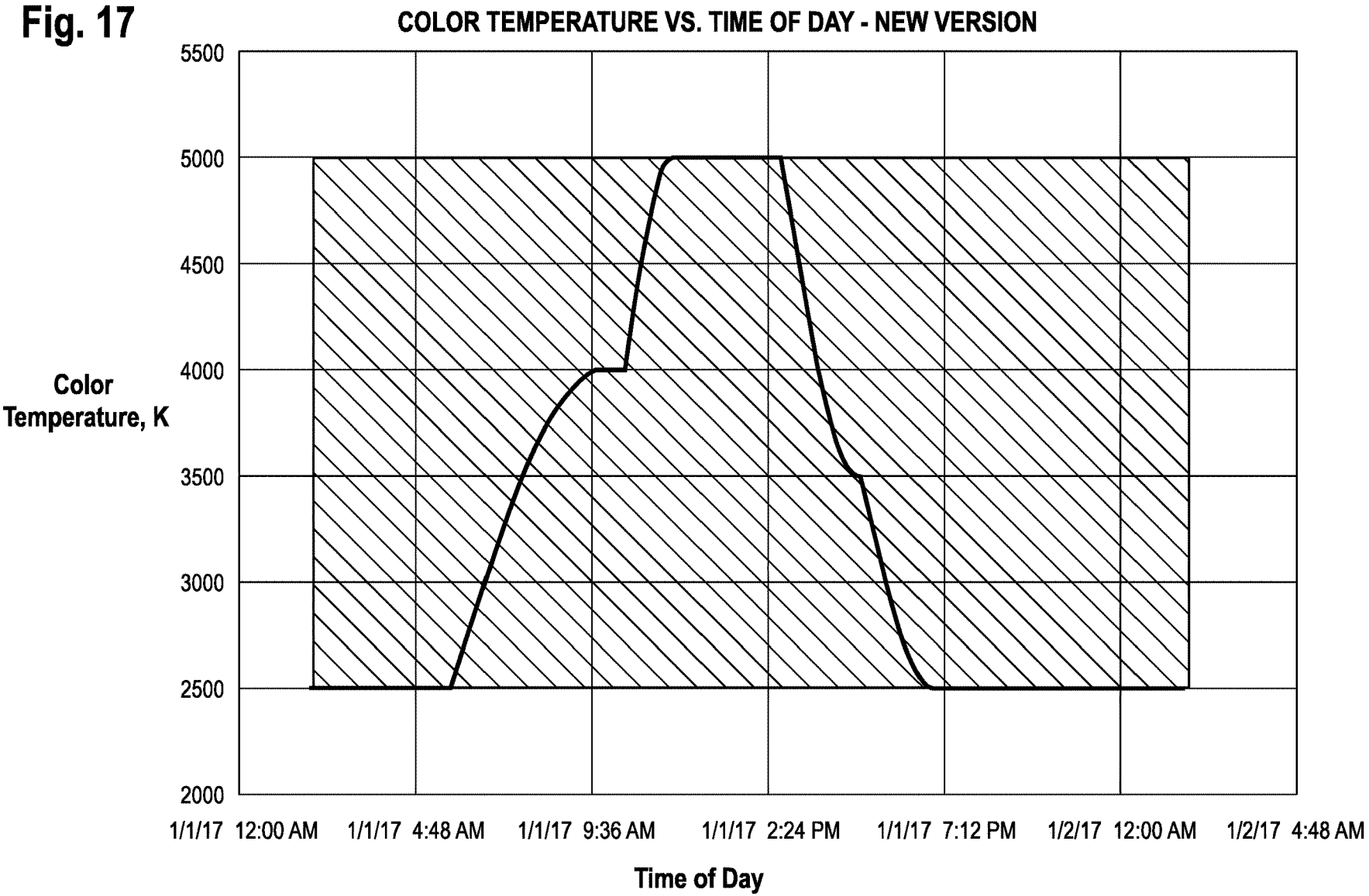
FIG. 17 is a graph showing the color temperature v. time of day for the light.

Referring to FIG. 17 and Tables 1 and 2, the control system is operable, or may be programmed, to change the color temperature of the light source between at least first and second color temperatures associated with at least first and second time periods. The processor, or controller, also is programmed to vary the time periods depending on the day of the year, such that, for example, the second time period may be longer, and the first time period shorter, during the summer, and vice versa in the winter. A first color temperature transition runs for a third time period between the first and second time period, while a fourth color temperature transition runs for a fourth time period between the second and first time period. For example, and referring to Tables 1 and 2, and FIG. 17, the first time period occurs between 3 pm and 7 am, while the second time period occurs between 7 am and 3 pm, the first transition occurs between 4 am and 12 noon, and the second transition occurs between 2 pm and 9 pm. For example, the first time period may correspond to a 9 pm to 7 am night light, or sleeping time period, while the second time period may correspond to a 9 am to 3 pm examination, with the first transition period corresponding to the wake up time period between 7 am and am, and the second transition period occurring between 3 pm and 9 pm. Of course, other time periods, and transitions are possible, including general targets for visiting hours and relaxation as noted in Table 1. In one embodiment, the first color temperature is between 2000 and 3000 k, and preferably 2500 K, while the second color temperature is between 4000 k and 6000 k, and preferably 5000 k. The switch is operable, for example moveable to an on position, to turn the circadian rhythm light on. Referring to Table 2, the circadian rhythm light turns on at a designated color temperature (Col. C) and intensity (Col. D) correlated with a time of day or night the light is turned on. For example and without limitation, if the switch is turned on at 3:10 am on 1/1/17, the light will be at a color temperature of 2500 k and an intensity (brightness) of 20%. In this way, the user, or patient, is not subjected to a very bright light (e.g., 70% intensity) during the sleeping period. Conversely, when the light is switched on at 1:10 pm, for example, the light will be at a color temperature of 5000 k and an intensity of 70%. In this way, the user is apprised that the light was actually turned on, since ambient light at that time may mask a light turned on at a 20% intensity.

TABLE 1

General Targets - Activity, Color Temperature and Time of Day

GENERAL TARGETS

| Activity | Color Temp, K | Time of Day |
|---|---|---|
| Wake up | 4500 K | 7 am to 9 am |
| Examination | 5000 K | 9 am to 3 pm |
| Visiting Hours | 3500 K | 3 pm to 6 pm |
| Relaxation | 2700 K | 6 pm to 9 pm |
| Night Light | 2500 K | 9 pm to 7 am |

TABLE 2

Color Temperature and Initial Brightness Setting v. Time of Day

| Time of day window | | Color | Brightness | Target | Change | | | | Calc'd |
|---|---|---|---|---|---|---|---|---|---|
| from | to | Temp, K | Preset | points | increment | degrees | radians | SIN | Temp, K |
| Jan. 1, 2017 2:00 AM | Jan. 1, 2017 2:14 AM | 2500 | 20% | 2500 | | this is the dwell region | | | 2500 |
| Jan. 1, 2017 2:15 AM | Jan. 1, 2017 2:29 AM | 2500 | 20% | 2500 | | this is the dwell region | | | 2500 |
| Jan. 1, 2017 2:30 AM | Jan. 1, 2017 2:44 AM | 2500 | 20% | 2500 | | this is the dwell region | | | 2500 |
| Jan. 1, 2017 2:45 AM | Jan. 1, 2017 2:59 AM | 2500 | 20% | 2500 | | this is the dwell region | | | 2500 |
| Jan. 1, 2017 3:00 AM | Jan. 1, 2017 3:14 AM | 2500 | 20% | 2500 | | this is the dwell region | | | 2500 |
| Jan. 1, 2017 3:15 AM | Jan. 1, 2017 3:29 AM | 2500 | 20% | 2500 | | this is the dwell region | | | 2500 |
| Jan. 1, 2017 3:30 AM | Jan. 1, 2017 3:44 AM | 2500 | 20% | 2500 | | this is the dwell region | | | 2500 |
| Jan. 1, 2017 3:45 AM | Jan. 1, 2017 3:59 AM | 2500 | 20% | 2500 | | this is the dwell region | | | 2500 |
| Jan. 1, 2017 4:00 AM | Jan. 1, 2017 4:14 AM | 2500 | 20% | 2500 | | this is the dwell region | | | 2500 |
| Jan. 1, 2017 4:15 AM | Jan. 1, 2017 4:29 AM | 2500 | 20% | 2500 | | this is the dwell region | | | 2500 |
| Jan. 1, 2017 4:30 AM | Jan. 1, 2017 4:44 AM | 2500 | 20% | 2500 | | this is the dwell region | | | 2500 |
| Jan. 1, 2017 4:45 AM | Jan. 1, 2017 4:59 AM | 2500 | 20% | 2500 | | this is the dwell region | | | 2500 |
| Jan. 1, 2017 5:00 AM | Jan. 1, 2017 5:14 AM | 2500 | 20% | 2500 | | this is the dwell region | | | 2500 |
| Jan. 1, 2017 5:15 AM | Jan. 1, 2017 5:29 AM | 2500 | 20% | 2500 | | this is the dwell region | | | 2500 |
| Jan. 1, 2017 5:30 AM | Jan. 1, 2017 5:44 AM | 2500 | 20% | 2500 | | this is the dwell region | | | 2500 |
| Jan. 1, 2017 5:45 AM | Jan. 1, 2017 5:59 AM | 2500 | 20% | 2500 | | start ramp up to 4000 following this step | | | 2500 |
| Jan. 1, 2017 6:00 AM | Jan. 1, 2017 6:14 AM | 2638 | 20% | 2500 | 1 | 5.29411765 | 0.092399784 | 0.09226836 | 2638.40254 |
| Jan. 1, 2017 6:15 AM | Jan. 1, 2017 6:29 AM | 2776 | 20% | | 2 | 10.5882353 | 0.184799568 | 0.18374952 | 2775.62428 |
| Jan. 1, 2017 6:30 AM | Jan. 1, 2017 6:44 AM | 2910 | 20% | | 3 | 15.8823529 | 0.277199352 | 0.27366299 | 2910.49449 |
| Jan. 1, 2017 6:45 AM | Jan. 1, 2017 6:59 AM | 3042 | 20% | | 4 | 21.1764706 | 0.369599136 | 0.36124167 | 3041.8625 |
| Jan. 1, 2017 7:00 AM | Jan. 1, 2017 7:14 AM | 3169 | 50% | | 5 | 26.4705882 | 0.46199892 | 0.44573836 | 3168.60753 |
| Jan. 1, 2017 7:15 AM | Jan. 1, 2017 7:29 AM | 3290 | 50% | | 6 | 31.7647059 | 0.554398704 | 0.52643216 | 3289.64824 |
| Jan. 1, 2017 7:30 AM | Jan. 1, 2017 7:44 AM | 3404 | 50% | | 7 | 37.0588235 | 0.646798488 | 0.60263464 | 3403.95195 |
| Jan. 1, 2017 7:45 AM | Jan. 1, 2017 7:59 AM | 3511 | 50% | | 8 | 42.3529412 | 0.739198271 | 0.67369564 | 3510.54347 |
| Jan. 1, 2017 8:00 AM | Jan. 1, 2017 8:14 AM | 3609 | 50% | | 9 | 47.6470588 | 0.831598055 | 0.73900892 | 3608.51338 |
| Jan. 1, 2017 8:15 AM | Jan. 1, 2017 8:29 AM | 3697 | 50% | | 10 | 52.9411765 | 0.923997839 | 0.79801723 | 3697.02584 |
| Jan. 1, 2017 8:30 AM | Jan. 1, 2017 8:44 AM | 3775 | 50% | | 11 | 58.2352941 | 1.016397623 | 0.85021714 | 3775.3257 |
| Jan. 1, 2017 8:45 AM | Jan. 1, 2017 8:59 AM | 3843 | 50% | | 12 | 63.5294118 | 1.108797407 | 0.89516329 | 3842.74494 |
| Jan. 1, 2017 9:00 AM | Jan. 1, 2017 9:14 AM | 3899 | 70% | | 13 | 68.8235294 | 1.201197191 | 0.93247223 | 3898.70834 |
| Jan. 1, 2017 9:15 AM | Jan. 1, 2017 9:29 AM | 3943 | 70% | | 14 | 74.1176471 | 1.293596975 | 0.96182564 | 3942.73846 |
| Jan. 1, 2017 9:30 AM | Jan. 1, 2017 9:44 AM | 3974 | 70% | | 15 | 79.4117647 | 1.385996759 | 0.9829731 | 3974.45965 |
| Jan. 1, 2017 9:45 AM | Jan. 1, 2017 9:59 AM | 3994 | 70% | | 16 | 84.7058824 | 1.478396543 | 0.99573418 | 3993.60126 |
| Jan. 1, 2017 10:00 AM | Jan. 1, 2017 10:14 AM | 4000 | 70% | 4000 | | this is the dwell region | | | 4000 |
| Jan. 1, 2017 10:15 AM | Jan. 1, 2017 10:29 AM | 4000 | 70% | 4000 | | this is the dwell region | | | 4000 |
| Jan. 1, 2017 10:30 AM | Jan. 1, 2017 10:44 AM | 4000 | 70% | 4000 | | start ramp up to 5000 K after this step | | | 4000 |
| Jan. 1, 2017 10:45 AM | Jan. 1, 2017 10:59 AM | 4309 | 70% | | 1 | 18 | 0.314159265 | 0.30901699 | 4309.01699 |
| Jan. 1, 2017 11:00 AM | Jan. 1, 2017 11:14AM | 4588 | 70% | | 2 | 36 | 0.628318531 | 0.58778525 | 4587.78525 |

TABLE 2-continued

Color Temperature and Initial Brightness Setting v. Time of Day

| Time of day window | | Color | Brightness | Target | Change | | | | Calc'd |
|---|---|---|---|---|---|---|---|---|---|
| from | to | Temp, K | Preset | points | increment | degrees | radians | SIN | Temp, K |
| Jan. 1, 2017 11:15AM | Jan. 1, 2017 11:29 AM | 4809 | 70% | | 3 | 54 | 0.942477796 | 0.80901699 | 4809.01699 |
| Jan. 1, 2017 11:30 AM | Jan. 1, 2017 11:44 AM | 4951 | 70% | | 4 | 72 | 1.256637061 | 0.95105652 | 4951.05652 |
| Jan. 1, 2017 11:45 AM | Jan. 1, 2017 11:59 AM | 5000 | 70% | 5000 | | this is the dwell region | | | 5000 |
| Jan. 1, 2017 12:00 PM | Jan. 1, 2017 12:14 PM | 5000 | 70% | 5000 | | this is the dwell region | | | 5000 |
| Jan. 1, 2017 12:15 PM | Jan. 1, 2017 12:29 PM | 5000 | 70% | 5000 | | this is the dwell region | | | 5000 |
| Jan. 1, 2017 12:30 PM | Jan. 1, 2017 12:44 PM | 5000 | 70% | 5000 | | this is the dwell region | | | 5000 |
| Jan. 1, 2017 12:45 PM | Jan. 1, 2017 12:59 PM | 5000 | 70% | 5000 | | this is the dwell region | | | 5000 |
| Jan. 1, 2017 1:00 PM | Jan. 1, 2017 1:14 PM | 5000 | 70% | 5000 | | this is the dwell region | | | 5000 |
| Jan. 1, 2017 1:15 PM | Jan. 1, 2017 1:29 PM | 5000 | 70% | 5000 | | this is the dwell region | | | 5000 |
| Jan. 1, 2017 1:30 PM | Jan. 1, 2017 1:44 PM | 5000 | 70% | 5000 | | this is the dwell region | | | 5000 |
| Jan. 1, 2017 1:45 PM | Jan. 1, 2017 1:59 PM | 5000 | 70% | 5000 | | this is the dwell region | | | 5000 |
| Jan. 1, 2017 2:00 PM | Jan. 1, 2017 2:14 PM | 5000 | 70% | 5000 | | this is the dwell region | | | 5000 |
| Jan. 1, 2017 2:15 PM | Jan. 1, 2017 2:29 PM | 5000 | 70% | 5000 | | this is the dwell region | | | 5000 |
| Jan. 1, 2017 2:30 PM | Jan. 1, 2017 2:44 PM | 5000 | 70% | 5000 | | this is the dwell region | | | 5000 |
| Jan. 1, 2017 2:45 PM | Jan. 1, 2017 2:59 PM | 5000 | 70% | 5000 | start ramp down to 3500 following this step | | | | 5000 |
| Jan. 1, 2017 3:00 PM | Jan. 1, 2017 3:14 PM | 4977 | 70% | 5000 | 1 | 100 | 1.745329252 | 0.98480775 | 4977.21163 |
| Jan. 1, 2017 3:15 PM | Jan. 1, 2017 3:29 PM | 4910 | 70% | | 2 | 110 | 1.919862177 | 0.93969262 | 4909.53893 |
| Jan. 1, 2017 3:30 PM | Jan. 1, 2017 3:44 PM | 4799 | 70% | | 3 | 120 | 2.094395102 | 0.8660254 | 4799.03811 |
| Jan. 1, 2017 3:45 PM | Jan. 1, 2017 3:59 PM | 4649 | 70% | | 4 | 130 | 2.268928028 | 0.76604444 | 4649.06666 |
| Jan. 1, 2017 4:00 PM | Jan. 1, 2017 4:14 PM | 4464 | 70% | | 5 | 140 | 2.443460953 | 0.64278761 | 4464.18141 |
| Jan. 1, 2017 4:15 PM | Jan. 1, 2017 4:29 PM | 4250 | 70% | | 6 | 150 | 2.617993878 | 0.5 | 4250 |
| Jan. 1, 2017 4:30 PM | Jan. 1, 2017 4:44 PM | 4013 | 70% | | 7 | 160 | 2.792526803 | 0.34202014 | 4013.03021 |
| Jan. 1, 2017 4:45 PM | Jan. 1, 2017 4:59 PM | 3760 | 70% | | 8 | 170 | 2.967059728 | 0.17364818 | 3760.47227 |
| Jan. 1, 2017 5:00 PM | Jan. 1, 2017 5:14 PM | 3500 | 70% | 3500 | start ramp down to 2500 following this step | | | | 3500 |
| Jan. 1, 2017 5:15 PM | Jan. 1, 2017 5:29 PM | 3481 | 70% | | 1 | 101.25 | 1.767145868 | 0.98078528 | 3480.78528 |
| Jan. 1, 2017 5:30 PM | Jan. 1, 2017 5:44 PM | 3424 | 70% | | 2 | 112.5 | 1.963495408 | 0.92387953 | 3423.87953 |
| Jan. 1, 2017 5:45 PM | Jan. 1, 2017 5:59 PM | 3331 | 70% | | 3 | 123.75 | 2.159844949 | 0.83146961 | 3331.46961 |
| Jan. 1, 2017 6:00 PM | Jan. 1, 2017 6:14 PM | 3207 | 70% | | 4 | 135 | 2.35619449 | 0.70710678 | 3207.10678 |
| Jan. 1, 2017 6:15 PM | Jan. 1, 2017 6:29 PM | 3056 | 70% | | 5 | 146.25 | 2.552544031 | 0.55557023 | 3055.57023 |
| Jan. 1, 2017 6:30 PM | Jan. 1, 2017 6:44 PM | 2883 | 70% | | 6 | 157.5 | 2.748893572 | 0.38268343 | 2882.68343 |
| Jan. 1, 2017 6:45 PM | Jan. 1, 2017 6:59 PM | 2695 | 70% | | 7 | 168.75 | 2.945243113 | 0.19509032 | 2695.09032 |
| Jan. 1, 2017 7:00 PM | Jan. 1, 2017 7:14 PM | 2500 | 50% | 2500 | | this is the dwell region | | | 2500 |
| Jan. 1, 2017 7:15 PM | Jan. 1, 2017 7:29 PM | 2500 | 50% | 2500 | | this is the dwell region | | | 2500 |
| Jan. 1, 2017 7:30 PM | Jan. 1, 2017 7:44 PM | 2500 | 50% | 2500 | | this is the dwell region | | | 2500 |
| Jan. 1, 2017 7:45 PM | Jan. 1, 2017 7:59 PM | 2500 | 50% | 2500 | | this is the dwell region | | | 2500 |
| Jan. 1, 2017 8:00 PM | Jan. 1, 2017 8:14 PM | 2500 | 50% | 2500 | | this is the dwell region | | | 2500 |
| Jan. 1, 2017 8:15 PM | Jan. 1, 2017 8:29 PM | 2500 | 50% | 2500 | | this is the dwell region | | | 2500 |

TABLE 2-continued

Color Temperature and Initial Brightness Setting v. Time of Day

| Time of day window | | Color | Brightness | Target | Change | | | | Calc'd |
|---|---|---|---|---|---|---|---|---|---|
| from | to | Temp, K | Preset | points | increment | degrees | radians | SIN | Temp, K |
| Jan. 1, 2017 8:30 PM | Jan. 1, 2017 8:44 PM | 2500 | 50% | 2500 | | this is the dwell region | | | 2500 |
| Jan. 1, 2017 8:45 PM | Jan. 1, 2017 8:59 PM | 2500 | 50% | 2500 | | this is the dwell region | | | 2500 |
| Jan. 1, 2017 9:00 PM | Jan. 1, 2017 9:14 PM | 2500 | 50% | 2500 | | this is the dwell region | | | 2500 |
| Jan. 1, 2017 9:15 PM | Jan. 1, 2017 9:29 PM | 2500 | 50% | 2500 | | this is the dwell region | | | 2500 |
| Jan. 1, 2017 9:30 PM | Jan. 1, 2017 9:44 PM | 2500 | 50% | 2500 | | this is the dwell region | | | 2500 |
| Jan. 1, 2017 9:45 PM | Jan. 1, 2017 9:59 PM | 2500 | 50% | 2500 | | this is the dwell region | | | 2500 |
| Jan. 1, 2017 10:00 PM | Jan. 1, 2017 10:14 PM | 2500 | 50% | 2500 | | this is the dwell region | | | 2500 |
| Jan. 1, 2017 10:15 PM | Jan. 1, 2017 10:29 PM | 2500 | 50% | 2500 | | this is the dwell region | | | 2500 |
| Jan. 1, 2017 10:30 PM | Jan. 1, 2017 10:44 PM | 2500 | 50% | 2500 | | this is the dwell region | | | 2500 |
| Jan. 1, 2017 10:45 PM | Jan. 1, 2017 10:59 PM | 2500 | 50% | 2500 | | this is the dwell region | | | 2500 |
| Jan. 1, 2017 11:00 PM | Jan. 1, 2017 11:14 PM | 2500 | 20% | 2500 | | this is the dwell region | | | 2500 |
| Jan. 1, 2017 11:15 PM | Jan. 1, 2017 11:29 PM | 2500 | 20% | 2500 | | this is the dwell region | | | 2500 |
| Jan. 1, 2017 11:30 PM | Jan. 1, 2017 11:44 PM | 2500 | 20% | 2500 | | this is the dwell region | | | 2500 |
| Jan. 1, 2017 11:45 PM | Jan. 1, 2017 11:59 PM | 2500 | 20% | 2500 | | this is the dwell region | | | 2500 |
| Jan. 2, 2017 12:00 AM | Jan. 2, 2017 12:14 AM | 2500 | 20% | 2500 | | this is the dwell region | | | 2500 |
| Jan. 2, 2017 12:15 AM | Jan. 2, 2017 12:29 AM | 2500 | 20% | 2500 | | this is the dwell region | | | 2500 |
| Jan. 2, 2017 12:30 AM | Jan. 2, 2017 12:44 AM | 2500 | 20% | 2500 | | this is the dwell region | | | 2500 |
| Jan. 2, 2017 12:45 AM | Jan. 2, 2017 12:59 AM | 2500 | 20% | 2500 | | this is the dwell region | | | 2500 |
| Jan. 2, 2017 1:00 AM | Jan. 2, 2017 1:14 AM | 2500 | 20% | 2500 | | this is the dwell region | | | 2500 |
| Jan. 2, 2017 1:15 AM | Jan. 2, 2017 1:29 AM | 2500 | 20% | 2500 | | this is the dwell region | | | 2500 |
| Jan. 2, 2017 1:30 AM | Jan. 2, 2017 1:44 AM | 2500 | 20% | 2500 | | this is the dwell region | | | 2500 |
| Jan. 2, 2017 1:45 AM | Jan. 2, 2017 1:59 AM | 2500 | 20% | 2500 | | this is the dwell region | | | 2500 |

Hook

Referring to FIGS. 1 and 16, a hook 240 includes a base portion 242 that may be secured to the rear wall 213 of the storage, the back frame 36 or frame structure 8. The hook 240 includes an upright portion 244 extending upwardly from the base portion, and a blade portion 246 extending outwardly and upwardly from the upright portion. The upright and blade portions may be formed from a single loop, with two parallel members 248, 250 spaced apart a distance D, and with the end of the blade portion terminating in a curved portion 252. Various accessories, including personal items such as articles of clothing or bags, may be positioned and stored on the blade portion 246. The hook may be made of plastic, metal, wood, or combinations thereof.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A body support structure comprising:

a base defining an upwardly facing first body support surface;

a cushion moveable between a seating configuration and a sleeping configuration, wherein at least a portion of the cushion is spaced above the first body support surface when in the seating configuration, and wherein the cushion is supported by and overlies at least a portion of the first body support surface when in the sleeping configuration, and wherein the cushion defines a forwardly facing second body support surface when in the seating configuration and an upwardly facing third body support surface when in the sleeping configuration, and wherein the first body support surface supports the second body support surface when the cushion is in the sleeping configuration; and a spacer comprising first and second support surfaces, wherein the spacer is pivotally coupled to the base and is pivotal between an upright position, wherein the first support surface engages and vertically supports the cushion in the seating configuration, and a down position, wherein the second support surface engages and vertically supports the second body support surface of the cushion in the sleeping configuration.

2. The body support structure of claim 1 wherein the cushion comprises a first section rotatably connected to a second section, wherein the first section defines the second body support surface and a first portion of the third body support surface, and wherein the second section defines a second portion of the third body support surface, wherein the first and second sections are moveable relative to each other between the seating configuration, wherein the first and second portions of the third body support surface are facing each other, and the sleeping configuration, wherein the first and second portions of the third body support surface are substantially planar.

3. The body support structure of claim 2 wherein the first body supporting surface is angled downwardly an acute angle relative to a horizontal plane as the first body supporting surface extends rearwardly.

4. The body support structure of claim 3 wherein the third body support surface is substantially horizontal when the cushion is in the sleeping configuration.

5. The body support structure of claim 3 wherein the second body support surface and the first portion of the third body support surface are tapered relative to each other.

6. The body support structure of claim 5 wherein the second section comprises a rearwardly facing surface opposite the second portion of the third body support surface when the cushion is in the seating configuration, and wherein the rearwardly facing surface and the second portion of the third body supporting surface are tapered relative to each other.

7. The body support structure of claim 2 wherein the spacer is connected to the first section with a tether.

8. The body support structure of claim 2 wherein the first section comprises a support layer defining the third body support surface and a cushion layer defining the second body support surface.

9. The body support structure of claim 1 further comprising a spring biasing the spacer to the down position.

10. The body support structure of claim 1 further comprising a rail disposed along a front of the base, and a table moveably supported on the rail, the table positioned above the first body support surface.

11. The body support structure of claim 10 wherein further comprising an upright moveably coupled to the rail, wherein the table is rotatably coupled to the upright.

12. The body support structure of claim 1 further comprising a first rail disposed along a front of the base and a second rail disposed along a rear of the base, and a canopy moveably supported on the first and second rails, wherein the canopy comprises a ceiling portion overlying the first body support surface.

13. The body support structure of claim 1 wherein the second support surface is forwardly facing when the spacer is in the upright position and upwardly facing when the spacer is in the down position.

14. The body support structure of claim 1 wherein the second support surface is visible to the user when the spacer is in the upright position.

15. A body support structure comprising:

a base defining an upwardly facing first body support surface;

a foldable cushion comprising first and second sections, each of the first and second sections being tapered from a first end to a second end and comprising first and second sides, wherein the second end of the first section is hingedly connected to the first end of the second section, wherein the first and second sections are moveable between a seating configuration, wherein the second sides are facing each other and the first sides are facing away from each other, and a sleeping configuration wherein the second sides are facing upwardly and define a second body support surface and the first sides are facing downwardly and are supported on the first body support surface, wherein the second body support surface is substantially horizontal when the first and second sections are in the sleeping configuration, wherein the first end of the first section is spaced above the first body support surface when the first and second sections are in the seating configuration, and wherein the first end of the first section is spaced above and vertically offset from the second end of the second section when the first and second sections are in the seating configuration such that the second side of the second section does not overlap with an entirety of the second side of the first portion when the first and second sections are in the seating configuration.

16. The body support structure of claim 15 wherein the first body supporting surface is angled downwardly an acute angle relative to a horizontal plane as the first body supporting surface extends rearwardly.

17. The body support structure of claim 15 wherein each of the first and second sections comprise a support layer proximal the second sides and a cushion layer proximal the first sides.

18. The body support structure of claim 15 further comprising a rail disposed along a front of the base, and a table moveably supported on the rail, the table positioned above the first body support surface.

19. The body support structure of claim 18 further comprising an upright moveably coupled to the rail, wherein the table is coupled to the upright.

20. The body support structure of claim 15 further comprising a first rail disposed along a front of the base and a second rail disposed along a rear of the base, and a canopy moveably supported on the first and second rails, wherein the canopy comprises a ceiling portion overlying the first body support surface.

21. A body support structure comprising:

a base defining an upwardly facing first body support surface;

a foldable cushion comprising first and second sections, each of the first and second sections being tapered from a first end to a second end and comprising first and second sides, wherein the second end of the first section is hingedly connected to the first end of the second section, wherein the first and second sections are moveable between a seating configuration, wherein the second sides are facing each other and the first sides are facing away from each other, and a sleeping configuration wherein the second sides are facing upwardly and define a second body support surface and the first sides are facing downwardly and are supported on the first body support surface, wherein the second body support surface is substantially horizontal when the first and second sections are in the sleeping configuration; and a spacer comprising first and second support surfaces, wherein the spacer is pivotally coupled to the base and is pivotal between an upright position, wherein the first support surface engages and supports the first end of the first section, and a down position, wherein the second support surface engages and supports the first side of the first section when the first and second sections are in the sleeping configuration, wherein the second support surface faces forwardly when the spacer is in the upright position and wherein the second surface faces upwardly when the spacer is in the down position.

22. The body support structure of claim 21 wherein the spacer is coupled to the first section with a tether.

23. The body support structure of claim 21 wherein the spring biases the spacer to the down position.

* * * * *